US007095679B2

(12) United States Patent
Fujisawa et al.

(10) Patent No.: US 7,095,679 B2
(45) Date of Patent: Aug. 22, 2006

(54) ELECTRONIC TIMEPIECE, CONTROL METHOD FOR ELECTRONIC TIMEPIECE, REGULATING SYSTEM FOR ELECTRONIC TIMEPIECE, AND REGULATING METHOD FOR ELECTRONIC TIMEPIECE

(75) Inventors: Teruhiko Fujisawa, Suwa (JP); Takashi Kawaguchi, Suwa (JP); Fumiaki Miyahara, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 120 days.

(21) Appl. No.: 10/959,684

(22) Filed: Oct. 6, 2004

(65) Prior Publication Data

US 2005/0041533 A1 Feb. 24, 2005

Related U.S. Application Data

(63) Continuation of application No. 10/288,064, filed on Nov. 5, 2002, now Pat. No. 6,850,468, which is a continuation-in-part of application No. 09/856,187, filed as application No. PCT/JP00/06354 on May 16, 2001, now abandoned.

(30) Foreign Application Priority Data

Sep. 17, 1999 (JP) ..... 11-264472

(51) Int. Cl.
*G04C 11/02* (2006.01)

(52) U.S. Cl. ..... 368/47; 368/52

(58) Field of Classification Search ..... 368/47, 368/52, 53, 55
See application file for complete search history.

(56) References Cited

U.S. PATENT DOCUMENTS

| | | | |
|---|---|---|---|
| 3,643,420 | A | 2/1972 | Haydon |
| 4,023,344 | A | 5/1977 | Mukaiyama |
| 4,147,022 | A | 4/1979 | Ichikawa |
| 4,918,416 | A | 4/1990 | Walton et al. |
| 5,777,950 | A | 7/1998 | Helm et al. |
| 5,798,709 | A | 8/1998 | Flaxl |
| 6,269,055 | B1 | 7/2001 | Pikula et al. |
| 6,542,438 | B1 | 4/2003 | Higuchi et al. |
| 2001/0043511 | A1 | 11/2001 | Higuchi et al. |

FOREIGN PATENT DOCUMENTS

| | | |
|---|---|---|
| EP | 0 635 771 A1 | 1/1995 |
| EP | 0 949 548 A1 | 10/1999 |
| JP | 6-258464 | 9/1994 |
| JP | 11-84028 | 3/1999 |

*Primary Examiner*—Kamand Cuneo
*Assistant Examiner*—Thanh S Phan
(74) *Attorney, Agent, or Firm*—Rosalio Haro

(57) ABSTRACT

In an analog electrical timepiece with a motor coil, when an external operating member is in a prescribed operating condition, the operating mode of the analog electrical timepiece is set to the data receive mode. Next, the analog timepiece generates a synchronization signal which is in synchronized to an external synchronization signal that is input from outside. Then, the analog electrical timepiece, when the operating mode is the data receive mode by the detection circuit, based on a synchronization signal and a data voltage signal that is a voltage signal induced around the motor coil by a data signal input from outside, generates and outputs a receive data.

19 Claims, 18 Drawing Sheets

FIG. 14

| INSTRUCTION COMMAND | ORDER CODE | | | | DATA (8 bit) |
|---|---|---|---|---|---|
| | C1 | C2 | C3 | C4 | |
| DATA A TRANSMISSION | 1 | 0 | 0 | 1 | DATA SIGNAL |
| DATA B TRANSMISSION | 1 | 0 | 1 | 0 | DATA SIGNAL |
| DATA C TRANSMISSION | 1 | 0 | 1 | 1 | DATA SIGNAL |
| TERMINATION OF RECEIVE MODE | 0 | 1 | 0 | 1 | DUMMY DATA |

ELECTRONIC TIMEPIECE, CONTROL METHOD FOR ELECTRONIC TIMEPIECE, REGULATING SYSTEM FOR ELECTRONIC TIMEPIECE, AND REGULATING METHOD FOR ELECTRONIC TIMEPIECE

CONTINUING APPLICATION DATA

This application is a continuation of 10/288,064, filed on Nov. 5, 2002 now U.S. Pat. No. 6,850,468, which is a continuation-in-part application of application Ser. No. 09/856,187, filed on May 16, 2001 now abandoned, which is a 371 of PCT/JP00/06354, filed on Sep. 18, 2000. The contents of each of which are incorporated herein by reference.

BACKGROUND OF THE INVENTION

1. Field of the Invention

The present invention relates to an electronic timepiece and a control method for the electrical timepiece, and in particular to an analog electronic timepiece with a drive motor and a control method thereof.

2. Description of the Related Art

The present invention relates to an electronic timepiece and a control method for the electrical timepiece, and in particular to an analog electronic timepiece with a drive motor and a control method thereof.

DESCRIPTION OF THE RELATED ART

Some analog electronic timepieces have data storage circuits for storing data used in various control operations. To write data into this data storage circuit, one typically needs bring a terminal of an externally provided data writing device into physical contact with a circuit board on which the data storage circuit is installed in order to make electrical contact.

Also, an electrical timepiece with a built-in generator has been made commercially available. Since it is not necessary to change any batteries in this type of timepiece, timepieces whose case and back cover are constructed as a one-piece unit in order to enhance water resistance quality have also been commercialized.

In the above analog electronic timepiece, data is typically written into its data storage circuit during assembly while its circuit board is exposed. In order to update the data after assembly, it is necessary to open the timepiece's back cover in order to once again expose the circuit board. This results in a drawback of increased steps.

This drawback is especially apparent in an electrical timepiece having its case and back cover constructed as a one-piece unit, such as described above. In order to expose a circuit board with such an electrical timepiece, it is necessary to remove its hands and the clock face, which is complicated and time-consuming work.

Therefore, an object of the present invention is to provide, in an electrical timepiece in a finished product state and assembled within a case, an electronic timepiece, a control method for the electronic timepiece, a regulating system for the electronic timepiece, and a regulating method for the electronic timepiece which are able to write data easily and do not have a complicated structure.

SUMMARY OF THE INVENTION

A first aspect of the present invention is characterized by electronic timepiece comprising:

a coil a synchronization signal generating unit for generating, when an operation mode is in a data receive mode, a synchronization signal that is synchronous with an external synchronization signal transmitted from an external transmitting device;

a received data generating unit for generating, when the operation mode is in the data receive mode, a received data on the basis of a synchronization signal and a data voltage signal induced around the coil by data signal input from the external transmitting device, and outputting the received data; and a mode setting unit for switching the operation mode between the data receive mode and a normal operation mode, the mode setting unit shifting the operation mode to the normal operation mode when the external synchronization signal is not inputted within a predetermined period during the data receive mode.

A second aspect of the present invention is characterized, in the first aspect of the present invention, by the received data generating unit comprising:

boosting means for chopper-boosting an induced current of the coil by intermittently switching an induced current, which passes through the coil, in the driving circuit according to the synchronization signal; and detecting means for generating the received data by comparing the chopper-boosted induced current with a predetermined threshold.

A third aspect of the present invention is characterized, in the second aspect of the present invention, by the boosting means comprising:

a first transistor connecting one end of the coil and a first power supply line;

a second transistor connecting one end of the coil and a second power supply line;

a third transistor connecting another end of the coil and the first power supply line; and a fourth transistor connecting another end of the coil and the second power supply line, and wherein, the boosting means chopper-boosts an induced current of the coil when detecting the received data by turning the first transistor to an on state, turning the third and fourth transistors to an off state, and turning the second transistor from an on state to an off state for a predetermined period according to the synchronization signal.

A fourth aspect of the present invention is characterized in that, in the third aspect of the present invention, the coil is a motor coil, and wherein the boosting means is a circuit constituting a driving circuit which drives the motor coil.

A fifth aspect of the present invention is characterized, in the first aspect of the present invention, by the coil, which is a motor coil.

A sixth aspect of the present invention is characterized in, in the first aspect of the present invention, comprising a signal input unit for inputting signal, and that the mode setting unit shifts, when a signal input via the signal input unit is a prescribed signal determined in advance, the operation mode to the data receive mode.

A seventh aspect of the present invention is characterized in that, in the sixth aspect of the present invention, the signal input unit comprises an external operation unit for performing various operations, and the prescribed signal is output to the mode setting unit, when operating condition of the external operation unit is in a prescribed operating condition determined in advance.

A eighth aspect of the present invention is characterized in that, in the sixth aspect of the present invention, the coil is a motor coil, and further comprises a motor pulse output prohibit unit for, when the operation mode is in the data receive mode, prohibiting of output of a motor pulse to the motor coil.

A ninth aspect of the present invention is characterized in that, in the sixth aspect of the present invention, the mode setting unit shifts, when a data with a predetermined amount of bits is received after the operation mode is shifted to the data receive mode, the operation mode from the data receive mode to the normal operation mode in which the normal operation is carried out.

A tenth aspect of the present invention is characterized in that, in the first aspect of the present invention, the coil is a motor coil, the motor coil is a coil to which a motor pulse is output at regular intervals, and the mode setting unit sets the operation mode to the data receive mode only during a prescribed time period determined in advance of a non-output time period of the motor pulse.

An eleventh aspect of the present invention is characterized by, in the first aspect of the present invention, further comprising: a receive data storing unit for storing the receive data; and a data storage control unit for, when a prescribed number, which number is determined in advance, of the identical receive data is received, storing the receive data into the receive data storing unit.

A twelfth aspect of the present invention is characterized in that, in the eleventh aspect of the present invention, the receive data storing unit comprises: a non-volatile memory unit for non-volatilely storing the receive data; and a data writing unit for writing the receive data in the non-volatile memory unit.

A thirteenth aspect of the present invention is characterized by, in the first aspect of the present invention, further comprising a comparator for, by comparing voltage of the data voltage signal and a prescribed reference voltage determined in advance, generating and outputting the receive data.

A fourteenth aspect of the present invention is characterized by, in the thirteenth aspect of the present invention, further comprising a comparator operation controller unit for, only during a prescribed time period including during the data receive mode, making the comparator into an operation enabled state.

A fifteenth aspect of the present invention is characterized by, in the thirteenth aspect of the present invention, further comprising a power supply controller unit for, only during a prescribed time period including during the data receive mode, supplying operating power to the comparator.

A sixteenth aspect of the present invention is characterized by, in the first aspect of the present invention, further comprising an inverter for, by comparing voltage of the data voltage signal with a prescribed reference voltage determined in advance, generating and outputting the receive data.

A seventeenth aspect of the present invention is characterized by an electronic timepiece comprising:

a coil;

a synchronization signal generating unit for generating, when an operation mode is in a data receive mode, a synchronization signal that is synchronous with an external synchronization signal transmitted from an external transmitting device;

a received data generating unit for generating, when the operation mode is in the data receive mode, a received data on the basis of the synchronization signal and a data voltage signal induced around the coil by data signal input from the external transmitting device, and outputting the received data; and a mode setting unit for switching the operation mode between the data receive mode and a normal operation mode, the mode setting unit shifting the operation mode to the normal operation mode when a termination order is received during the data receive mode.

A eighteenth aspect of the present invention is characterized in, in the seventeenth aspect of the present invention, that the received data generating unit comprising:

boosting means for chopper-boosting an induced current of the coil by intermittently switching an induced current, which passes through the coil, in the driving circuit according to the synchronization signal; and detecting means for generating the received data by comparing the chopper-boosted induced current with a predetermined threshold.

A nineteenth aspect of the present invention is characterized in that a regulating system for an electronic timepiece comprising an electrical timepiece and an external device, wherein the electrical timepiece comprises;

a coil;

a synchronization signal generating unit for generating, when an operation mode is in a data receive mode, a synchronization signal that is synchronous with an external synchronization signal transmitted from an external transmitting device;

a received data generating unit for generating, when the operation mode is in the data receive mode, a received data on the basis of the synchronization signal and a data voltage signal induced around the coil by data signal input from the external transmitting device, and outputting the received data; and a mode setting unit for switching the operation mode between the data receive mode and a normal operation mode, the mode setting unit shifting the operation mode to the normal operation mode when the external synchronization signal is not inputted within a predetermined period during the data receive mode, and the external device comprises;

a receiver unit for receiving as a receive signal a signal transmitted via the coil of the electrical timepiece, and a transmitter unit for generating, based on the receive signal, a regulating data signal and transmitting the result to the electrical timepiece.

A twentieth aspect of the present invention is characterized in that, in the nineteenth aspect of the present invention, the coil of the electronic timepiece is a motor coil.

A twenty-first aspect of the present invention is characterized by a control method for an electronic timepiece with a coil comprising: a received data generating step for establishing, when an operation mode is in a receive mode, synchronization with an external synchronization signal transmitted from an external transmitter device and generating a received data, on the basis of the synchronization signal and a data voltage signal induced around the coil by data signal input from the external transmitter device, when the operation mode is the data receive mode; and a mode setting step for shifting the operation mode of the electrical timepiece from the data receive mode to a normal operation mode, the operation mode being shifted to the normal operation mode when the synchronization signal is not inputted within a predetermined period during the data receive mode.

A twenty-second aspect of the present invention is characterized in that, in the twenty-first aspect of the present invention, the received data generating step comprising:

a boosting step for chopper-boosting an induced current of the coil by intermittently switching an induced current, which passes through the coil, in the driving circuit according to the synchronization signal; and a detecting step for generating the received data by comparing the chopper-boosted induced current with a predetermined threshold.

A twenty-third aspect of the present invention is characterized in that, in the twenty-second aspect of the present invention, the electronic timepiece comprising:

a first transistor connecting one end of the coil and a first power supply line;

a second transistor connecting one end of the coil and a second power supply line;

a third transistor connecting another end of the coil and the first power supply line; and a fourth transistor connecting another end of the coil and the second power supply line, and wherein, in the boosting step, an induced current of the coil is chopper-boosted when detecting the received data by turning the first transistor to an on state, turning the third and fourth transistors to an off state, and turning the second transistor from an on state to an off state for a predetermined period according to the synchronization signal.

A twenty-fourth aspect of the present invention is characterized in, in the twenty-first aspect of the present invention, comprising a signal input unit for inputting signal and that the mode setting step shifts, when signal input via the signal input unit is a prescribed signal determined in advance, the operation mode to the data receive mode.

A twenty-fifth aspect of the present invention is characterized in that, in the twenty-fourth aspect of the present invention, the electrical timepiece comprises an external operating member for performing various operations, and the mode setting step shifts, when operating condition of the external operating member is in prescribed operating condition determined in advance, the operation mode to the data receive mode.

A twenty-sixth aspect of the present invention is characterized in that, in the twenty-fourth aspect of the present invention, the coil is a motor coil and the method further comprises a motor pulse output prohibit step for prohibiting of output of motor pulse to the motor coil, when the operation mode is the data receive mode, A twenty-seventh aspect of the present invention is characterized in that, in the twenty-fourth aspect of the present invention, the mode setting step shifts, when a data with a predetermined amount of bits is received after the operation mode is shifted to the data receive mode, the operation mode from the data receive mode to the normal operation mode in which the normal operation is carried out.

A twenty-eighth aspect of the present invention is characterized in that, in the twenty-first aspect of the present invention, the coil is a motor coil, motor pulse is output at a constant intervals to the motor coil, and the mode setting step sets the operation mode to the data receive mode only during a prescribed time period determined in advance of a non-output time period of the motor pulse.

A twenty-ninth aspect of the present invention is characterized by, in the twenty-first aspect of the present invention, further comprising a receive data storing step for storing the receive data, and a data storage control step for, when a prescribed number, which number is determined in advance, of the identical receive data is received, storing the receive data during the receive data storing step.

A thirtieth aspect of the present invention is characterized in that, in the twenty-ninth aspect of the present invention, the receive data storing step comprises a data writing step for writing the receive data in a non-volatile memory of the electrical timepiece.

A thirty-first aspect of the present invention is characterized in that, in the twenty-first aspect of the present invention, the electrical timepiece comprises a comparator for, by comparing voltage of the data voltage signal with a prescribed reference voltage determined in advance, generating and outputting the receive data, and the control method further comprises a comparator operation control step for, only during a prescribed time period including during the data receive mode, making the comparator into an operation enabled state.

A thirty-second aspect of the present invention is characterized by, in the thirty-first aspect of the present invention, further comprising a power supply control step for, only during a prescribed time period including during the data receive mode, supplying operating power to the comparator.

A thirty-third aspect of the present invention is characterized by a control method for an electronic timepiece with a coil comprising:

a received data generating step for establishing synchronization with an external synchronization signal transmitted from an external transmitter device, when an operation mode is in a receive mode, and generating a received data on the basis of the synchronization signal and a data voltage signal induced around the coil by data signal input from the external transmitter device, when the operation mode is the data receive mode; and a mode setting step for shifting the operation mode of the electrical timepiece from the data receive mode to a normal operation mode, the operation mode being shifted to the normal operation mode when a termination order is received during the data receive mode.

A thirty-fourth aspect of the present invention is characterized in, in the thirty-third aspect of the present invention, that data generating step comprising:

a boosting step for chopper-boosting an induced current of the coil by intermittently switching an induced current, which passes through the coil, in the driving circuit according to the synchronization signal; and a detecting step for generating the received data by comparing the chopper-boosted induced current with a predetermined threshold.

A thirty-fifth aspect of the present invention is characterized in that a regulating method for an electronic timepiece wherein the electronic timepiece comprising:

a coil;

a mode setting unit for shifting an operation mode between a data receive mode where data for the operation mode is received and a normal operation mode, the regulating method comprising:

regulating the electrical timepiece to, when operation mode of the electrical timepiece is in a receive mode, generate a synchronization signal that uses a synchronization timing signal as reference;

regulating the electrical timepiece to generate, based on the synchronization signal and data voltage signal induced around the coil by the input data signal, a receive data;

regulating an external device to receive a signal transmitted via the coil of the electrical timepiece as a receive signal;

regulating an external device to generate, based on the receive data, a regulating signal; and regulating an external device to transmit to the electrical timepiece the regulating signal, wherein the mode setting unit shifts the operation mode to the normal operation mode when a synchronization signal is not inputted within a predetermined period during the data receive mode.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

In the drawings wherein like reference symbols refer to like parts.

FIG. 14 is an explanatory drawing of instruction commands;

DESCRIPTION OF THE PREFERRED EMBODIMENTS

With reference to the drawings, a preferred embodiment of the present invention will be described next.

[1] First Embodiment

In the present, first exemplary embodiment, an external data writing device is used to transmit data to an analog electrical timepiece having analog hand. However, the present invention is not limited to the present embodiment, and other embodiments such as an electrical timepiece having a motor coil are considered within the scope of the present invention.

[1.1] Schematic Configuration of a Data Transmission System in Accord with a First Embodiment of the Present Invention.

Figure 1:
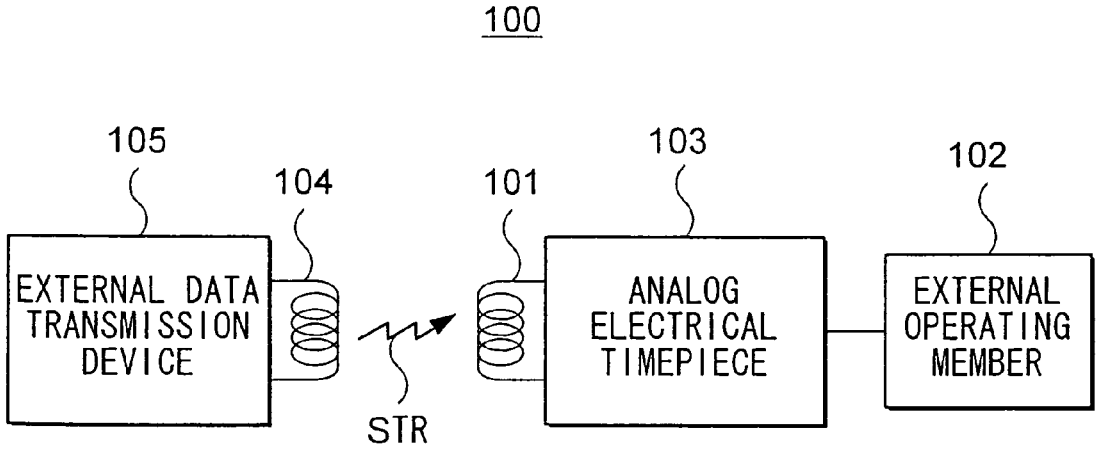
FIG. 1 is a schematic configuration block diagram of a data transmission system in accord with a first embodiment of the present invention.
Figure 18:
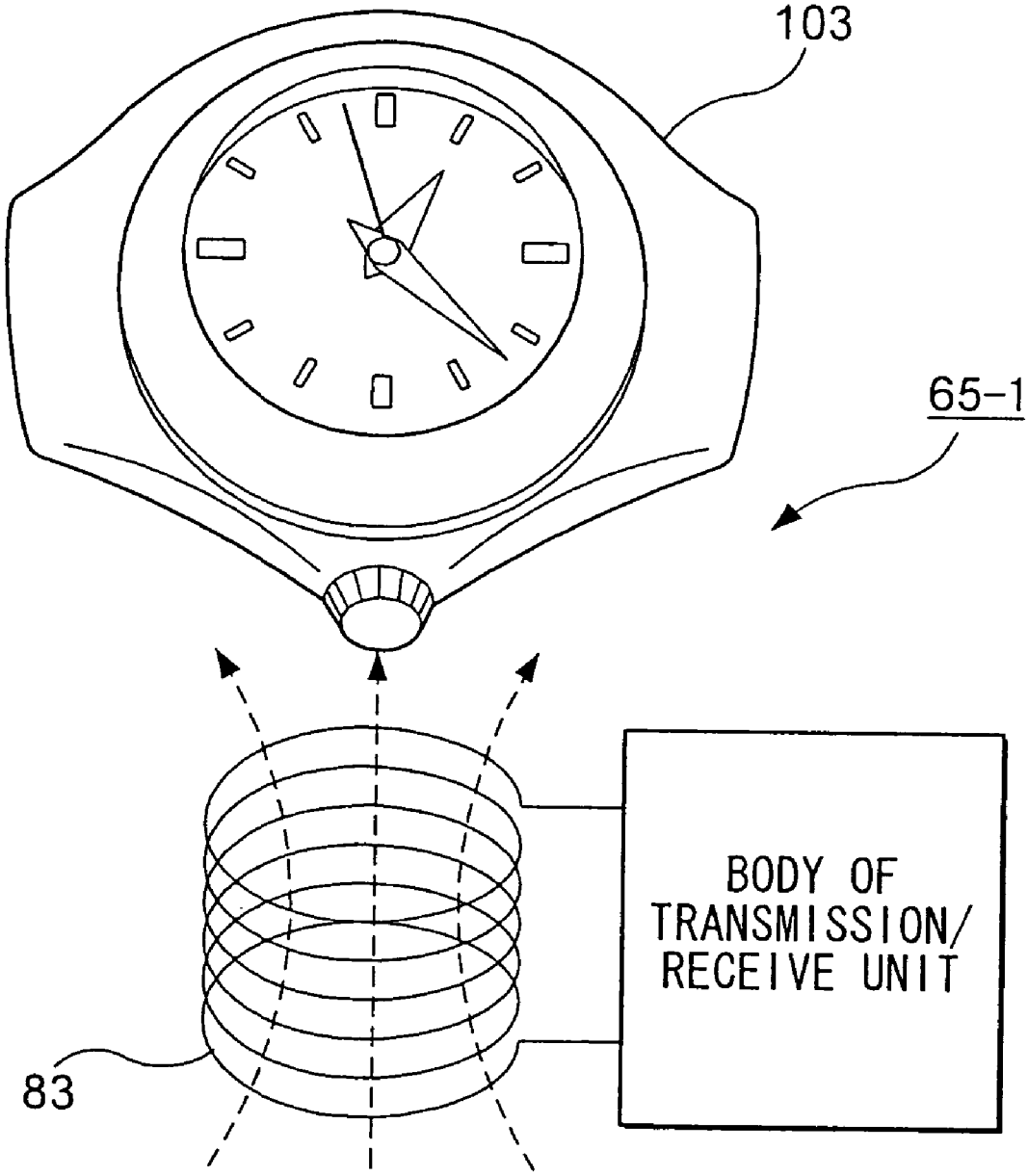
FIG. 18 is an explanatory drawing for a concrete mode during transmitting or receiving data.

FIG. 1 shows a schematic configuration block diagram of a data transmission system 100 in accord with the present invention. An analog electrical timepiece 103 of data transmission system 100 has a motor coil 101 and an external operating member 102, such as a crown or a button. An external data transmission device 105 preferably uses phase shift keying (PSK) modulation to modulate a carrier of a predetermined frequency according to data to be transmitted, and thereby generates data signal STR. The external data transmission device 105 then transmits data signal STR to the analog electrical timepiece 103 via a transmission coil 104. In the above case, the analog electronic timepiece 103 is preferably in its case, as shown in FIG. 18, while it receives data.

In the above case, the data content of transmitted data signal STR may be a pace regulation data signal, a correction data signal for various sensors, or a data signal for specification changes.

[1.2] Schematic Configuration of an External Data Transmission Device in Accord with the Present Invention.

Figure 3:
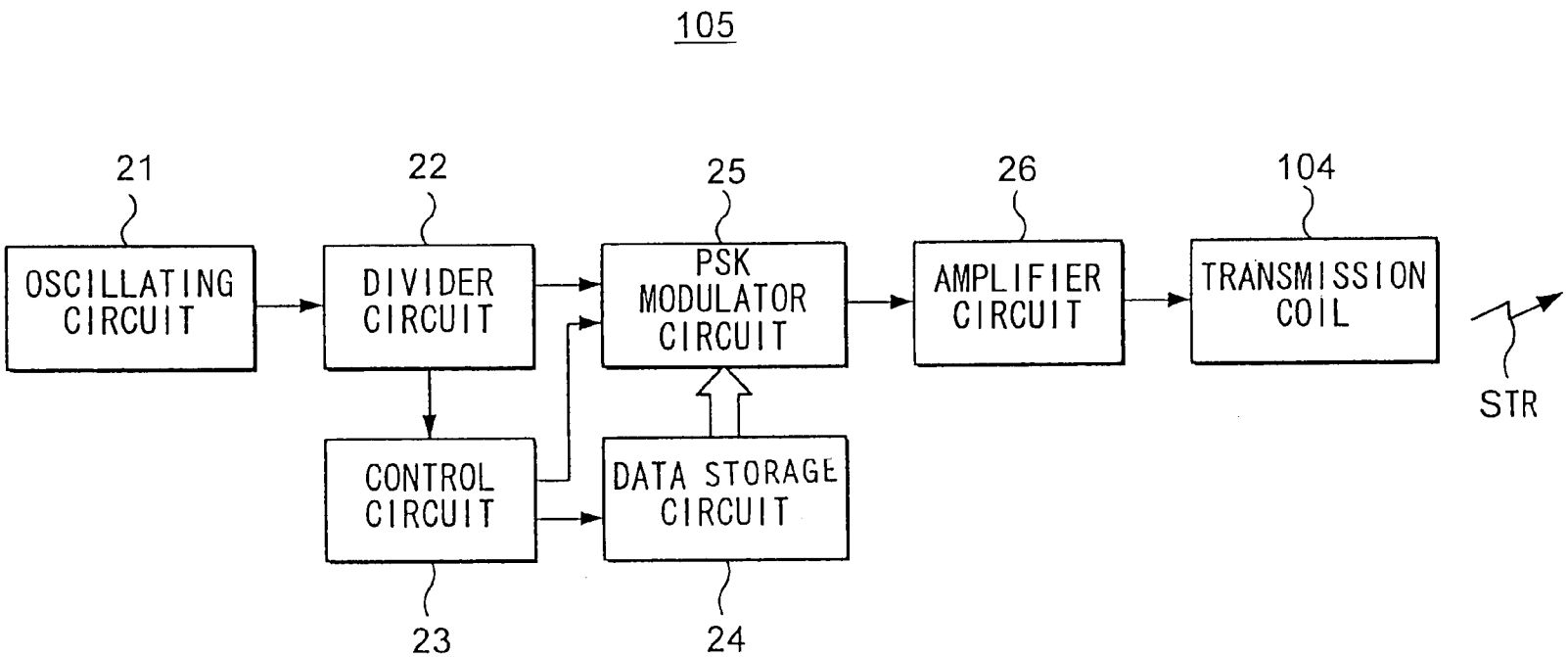
FIG. 3 is a schematic configuration block diagram of the external data transmission device of FIG. 1.

FIG. 3 shows a schematic configuration block diagram of some of the internal functional blocks of external data transmission device 105. An oscillating circuit 21 of the external data transmission device 105 may include a quartz crystal oscillator or a ceramic oscillator (neither is shown), and uses a reference oscillating signal generated by the included oscillator to generate a reference pulse signal having a predetermined reference frequency.

A frequency divider circuit 22 (referred to below as "divider circuit 22") outputs various pulse signals by dividing the reference pulse signal that is output from the oscillating circuit 21.

A control circuit 23 uses pulse signals output from the divider circuit 22 to control multiple parts of external data transmission device 105. In this case, control circuit 23 may include a CPU, a ROM, and a RAM, and is operated by the CPU based on a control program stored in the ROM. Instead of using a microprocessor, the control circuit 23 may also be configured with logic circuits.

A data storing circuit 24, under control of control circuit 23, stores various data and outputs various stored data.

A PSK modulator circuit 25, under control of control circuit 23 and based on transmission data read from the data storage circuit 24, implements phase shift keying modulation on reference signals output from divider circuit 22.

Specifically, PSK modulator circuit 25 performs modulation by inverting the phase of a reference signal on the basis of transmission data. For example, when the signal level of a signal to be transmitted is at a logic high, i.e. "H" level, the phase is put to 0 degree, and when signal level of the signal to be transmitted is at a logic low, i.e. "L" level, the phase is put to 180 degree.

An amplifier circuit 26 amplifies the output of the PSK modulator circuit 25, and the amplified signal is output as data signal STR via transmission coil 104.

[1.3] Schematic Configuration of an Analog Electronic Timepiece in Accord with the Present Invention.

Figure 2:
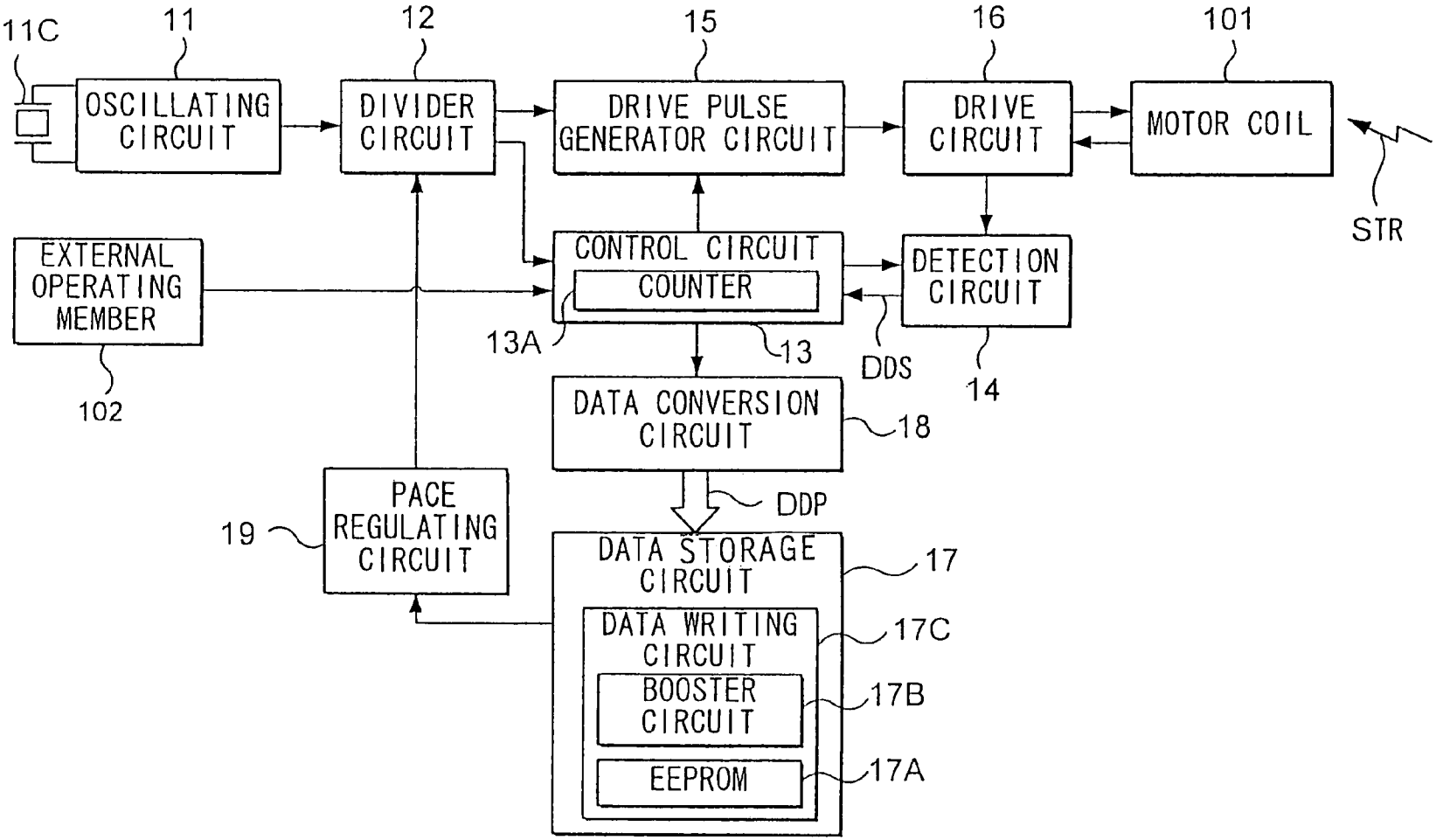
FIG. 2 is a schematic configuration block diagram of the analog electronic timepiece of FIG. 1.

FIG. 2 is a schematic configuration block diagram of analog electronic timepiece 103. An oscillating circuit 11 of the analog electronic timepiece 103 has a quartz crystal oscillator 11C. Oscillating circuit 11 a reference oscillation signal generated by the quartz crystal oscillator 11C to generate a reference pulse signal having a prescribed reference frequency. A frequency divider circuit 12 (identified below as divider circuit 12) divides the reference pulse signal output by the oscillating circuit 11, thereby outputs various pulse signals.

A controller circuit 13 has a counter 13A and, based on the various pulse signals output from divider circuit 12 and stored data from a data storage circuit 17 (described later), controls multiple parts of analog electronic timepiece 103. Counter 13A measures elapsed time t which is a time from a rising edge of a timing signal STM (which is later described). Controller circuit 13 determines whether or not the elapsed time t has reached a predetermined data detection stand-by time Ta by using the counter 13A. The counter 13A may be also used by the divider circuit 12 to reset the divider circuit 12 when measuring elapsed time t. Control circuit 13 is also responsive to an external operating member 102, discussed below.

A drive pulse generator circuit 15, on the basis of pulse signals outputted from divider circuit 12, generates drive pulses.

A drive circuit 16, on the basis of these drive pulses, feeds driving current to a motor coil 101 to drive a motor in an operation mode. Drive circuit 16 also boost an induced voltage in motor coil 101, wherein the voltage is induced by receiving data signal STR in a data receive mode.

Under control of the control circuit 13, a detection circuit 14 receives the boosted, induced voltage, Vch, from driving circuit 16. The detection circuit 14 then converts the boosted, induced voltage Vch into serial detection data, DDS, for output to control circuit 13.

A data conversion circuit 18 receives detection circuit 14's serial detection data DDS via control circuit 13. Data conversion circuit 18 provides serial-to-parallel conversion of serial detection data DDS to output a parallel detection data DDP to data storage circuit 17.

A pace regulating circuit 19 regulates a division ratio of divider circuit 12 to regulate a pace based on the parallel detection data DDP stored in data storage circuit 17.

In the above case, the data storage circuit 17 is equipped with a data writing circuit 17C. The data writing circuit 17C has an EEPROM 17B and a booster circuit 17A. The EEPROM 17B is a non-volatile memory which stores the parallel detection data DDP. The booster circuit 17A boosts a power supply voltage to generate a high programming voltage for writing to the EEPROM 17B.

[1.4] Schematic Configuration Around a Detection Circuit

Figure 4:
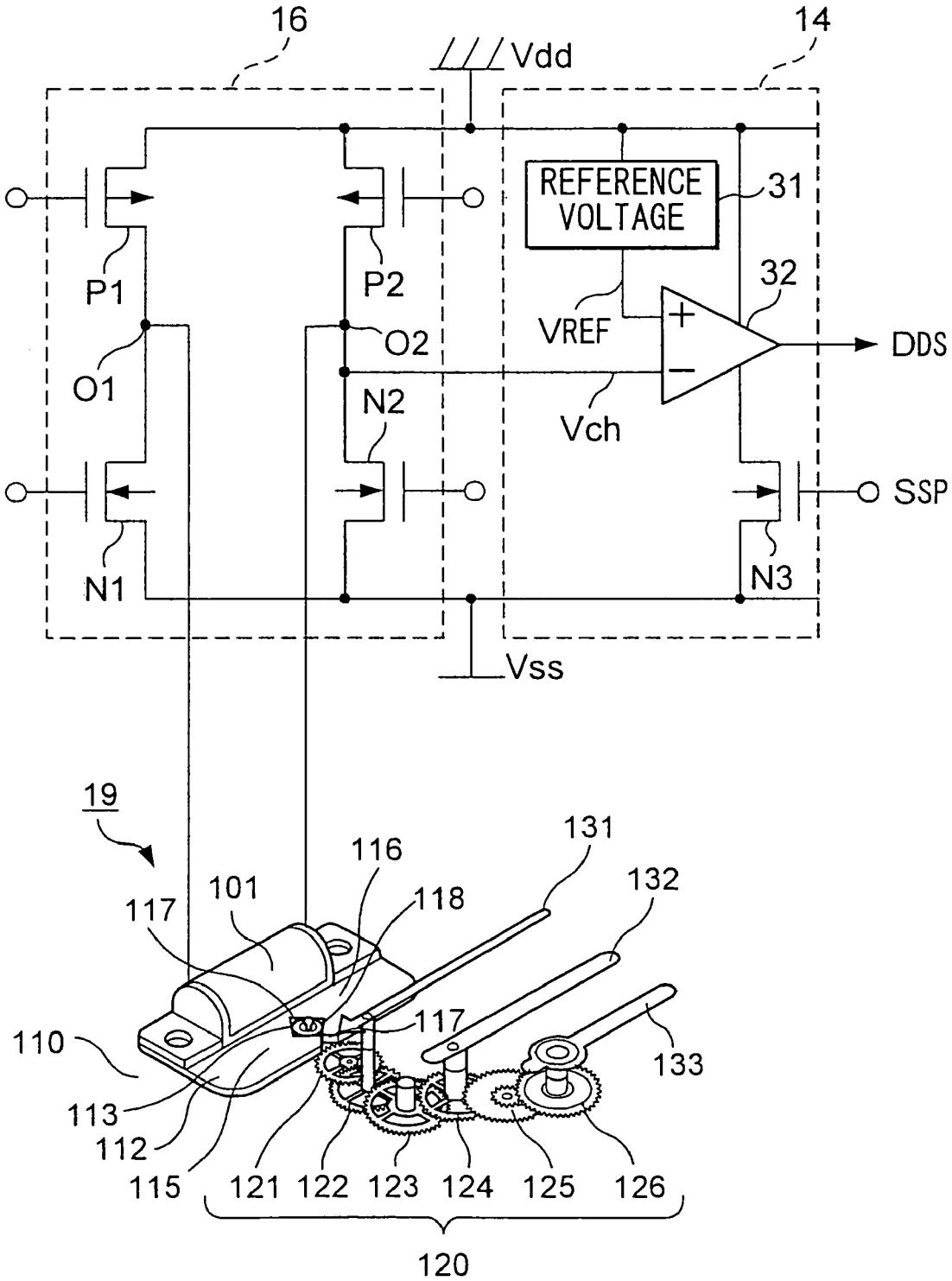
FIG. 4 is a schematic configuration block diagram of the detection circuit and drive circuit of FIG. 2 in conjunction with a hand drive unit 19.

With reference to FIG. 4, a schematic configuration of detection circuit 14 and drive circuit 16 in conjunction with a hand drive unit 19 will be described next.

Around the detection circuit 14, a hand drive unit 19 with drive circuit 16 and motor coil 101 is provided.

Drive unit 16 includes p-channel MOS transistors P1 and P2 and n-channel MOS transistors N1 and N2. The drain of p-channel transistor P1 is connected to the drain of n-channel transistor N1, and both transistors P1 and N1 are connected between the higher electric potential power supply Vdd and the lower electric potential power supply VSS. Similarly, the drain of p-channel MOS transistor P2 is connected to the drain of n-channel MOS transistor N2, and both transistors P2 and N2 are connected between the higher electric potential power supply Vdd and the lower electric potential power supply VSS.

MOS transistors P1, N1, P2, and N2 are controlled by drive pulse generator circuit 15 by means of signals applied to their respective gate terminals. Drive pulse generator circuit 15 controls these transistors so that in the above described operation mode, p-channel MOS transistor P1 and n-channel MOS transistor N2 are simultaneously turned ON/OFF, and p-channel MOS transistor P2 and n-channel MOS transistor N1 are simultaneously turned ON/OFF. When in the above described data receive mode, however, transistors P1, P2, N1 and N2 are controlled differently, as is described in greater detail below. In the operation mode, the motor 19 is driven in the following way.

First, transistors P1 and N2 are turned ON (i.e. placed in their ON state), and transistors P2 and N1 are turned OFF (i.e. placed in their OFF state). In this configuration, the drive current (i.e. drive pulse) from drive circuit 16 flows from the higher electric potential power supply Vdd through the p-channel MOS transistor P1 through the motor coil 101 through the n-channel MOS transistor N2 to the lower electrical potential power supply VSS.

Next, transistors P2 N1 are switched to their ON state, and transistors P1 and transistor N2 switched to their OFF state. In this configuration, the drive current (drive pulse) from drive circuit 16 flows from the higher electric potential power supply Vdd through the p-channel MOS transistor P2 through the motor coil 101 through the n-channel MOS transistor N1 to the lower electrical potential power supply VSS.

By repeating the above operations, alternating current is made to pass through the motor coil 101 and thereby drive motor 19.

The motor coil 101 of the hand drive unit 19 is part of a stepper motor 110. A stator 112 of the hand drive unit 19 is magnetized by the motor coil 101. A rotor 113 is made to rotate by an induced magnetic field in the stator 112. In this embodiment, stepper motor 110 is preferably of the PM-type (permanent magnet rotation type), in which the rotor 113 is configured as a disk-shaped two-pole permanent magnet.

The stator 112 has a magnetic saturation section 117 where electromotive force induced around the motor coil 101 produces unliked poles at poles 115 and 116, which are located around the rotor 113.

At a suitable place of the stator 112 a notch 118 is provided to regulate a direction of rotation. By means of the notch 118, cogging torque is produced to stop the rotor 113 at a suitable place.

Rotation of the rotor 113 of the stepping motor 110 is transmitted to hands via a gear train 120. The gear train 120 has a fifth wheel 121 engaged with the rotor 113, a fourth wheel 122, a third wheel 123, a second wheel 124, a minute wheel 125, and an hour wheel 126. On a shaft of the fourth wheel 122 is placed a seconds hand 131. On a shaft of the second wheel 124 is placed a minutes hand 132. On a shaft of the hour wheel 126 is placed an hours hand 133. These hands display time in accordance with the rotation of the rotor 113. The gear train 120 may be further equipped with other transmission systems for displaying a date.

As stated above, driving circuit 16 also serves as a part of a receiving circuit during the above-described data receive mode. In the data receive mode, the p-channel MOS transistor P1 is switched to the ON state and the n-channel MOS transistors N1 and N2 are switched to the OFF state. A pulse for alternating p-channel MOS transistor P2 between its ON and OFF states is transmitted to the gate of the p-channel MOS transistor P2, and the applied pulse preferably has a short period substantially similar to the period of data signal STR. When the pulse places p-channel transistor in its ON state, a current path is created from one end of coil 101 (node O1) through p-channel transistor P1, and back through p-channel transistor P2 to the other end of coil 101 (node O2). A closed circuit is thus created around coil 101. During this time, induced power is build up in coil 101 due to an induced current produced by the applied STR signal. As power is build up, the voltage difference between nodes O1 and O2 also builds up. The longer that the closed circuit is maintained, the more current, and thus more power, that is induced in coil 101. When the pulse signal turns OFF p-channel transistor P2, the closed circuit around coil 101 is broken, and the voltage build up at output node O2 is read by detection circuit 14. The value of the build up voltage level at output terminal O2 depends on the amount of current that passed through motor coil 101 up until p-channel transistor was turned OFF, and is thereby dependent on the level of data signal STR. Thus, the pulse signal at the control terminal of p-channel transistor P2 creates a switching operation that effectively boosts a voltage induced in motor coil 101 due to data signal STR. This type of boosting circuit/technique/action is preferably identified in the present application as a "chopper booster" or "chopper boosting" to emphasize the pulsing, or chopper, action of the pulse signal applied to the control gate of p-channel transistor P2. Similarly, the resultant boosted voltage is identified below as a chopper boosted voltage. Also, since the received data is detected, i.e. read, when transistor P2 is in its OFF state, and since the transistor P2 is placed in its OFF state in response to the pulse (i.e. chopper) signal at its control gate, the time intervals between successive readings of received data signals is identified below as chopper timing, or receive timing.

Figure 5:
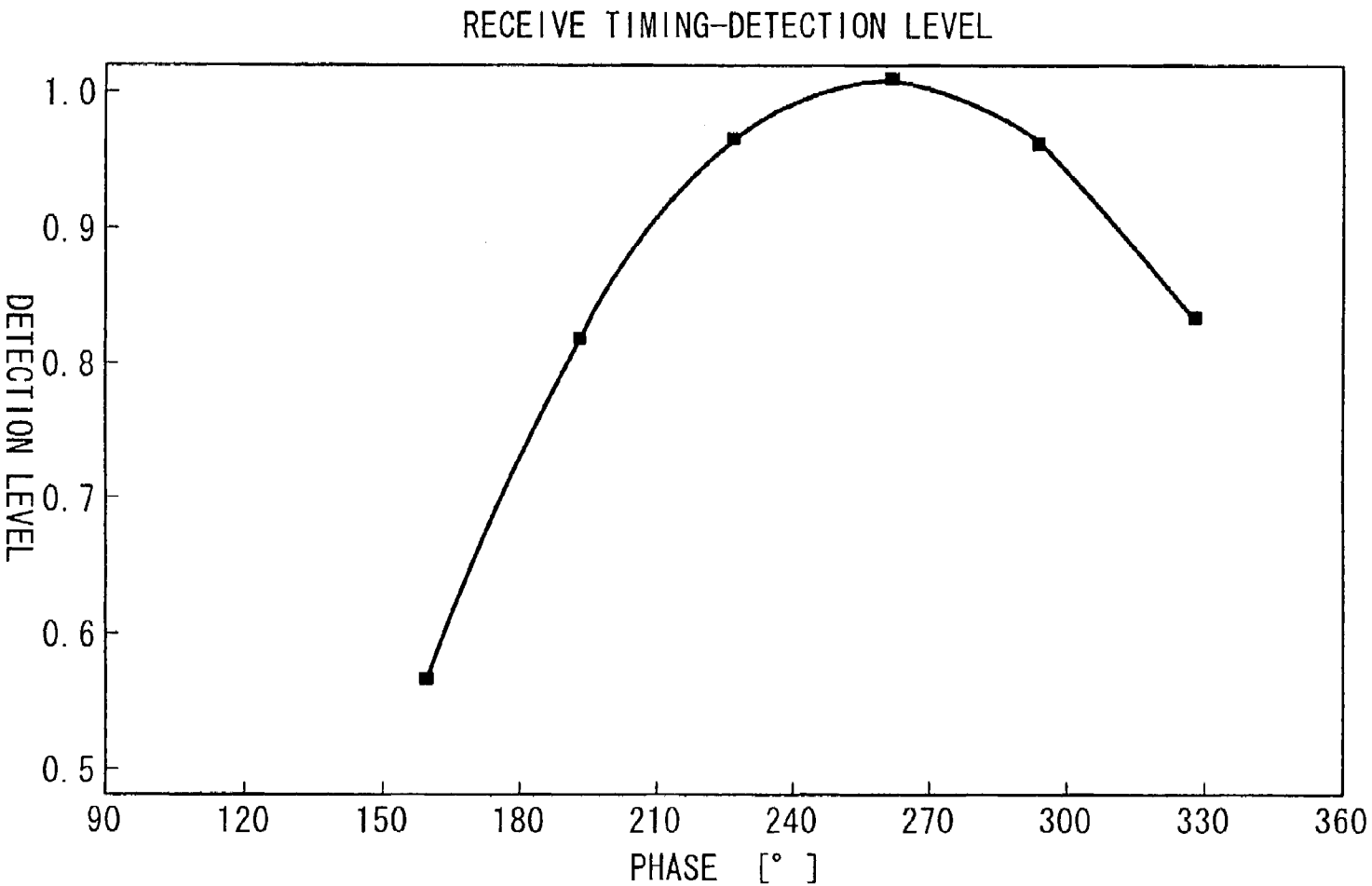
FIG. 5 is a diagram of a normalized characteristic curve showing voltage detection points along an induced received signal of the motor coil of FIG. 4 (identified as degree shifts along the received signal) and corresponding voltage detection levels.

FIG. 5 is a diagram of a normalized characteristic curve showing chopper timing (receive timing) for phases of received data signal STR and the detected voltage level (i.e. detection levels) of the consequently induced voltage of the motor coil 101. Specifically, the chopper timing is a timing interval indicating when p-channel MOS transistor P2 is turned OFF.

The detected voltage level of a chopper-boosted, induced voltage Vch is proportional to an amount of energy accumulated in motor coil 101 (due to its inductance) up until the accumulating, boosted, voltage Vch is ready to be read (i.e. detected) by detection circuit 14. That is, the energy accumulated during a time period defined by a specified chopper timing interval. As it would be understood, the amount of energy accumulated in motor coil 101 is a measure of the amount of an induced current passing through motor coil 101. As shown in FIG. 5, the detection level of a chopper-boosted induced voltage Vch is highest when the chopper timing coincides with a phase laps from the point when data signal STR is received to the point when received data signal STR is read (i.e. detected) is close to 270 degrees. In FIG. 5, the detection levels are normalized by the maximum value.

Figure 6:
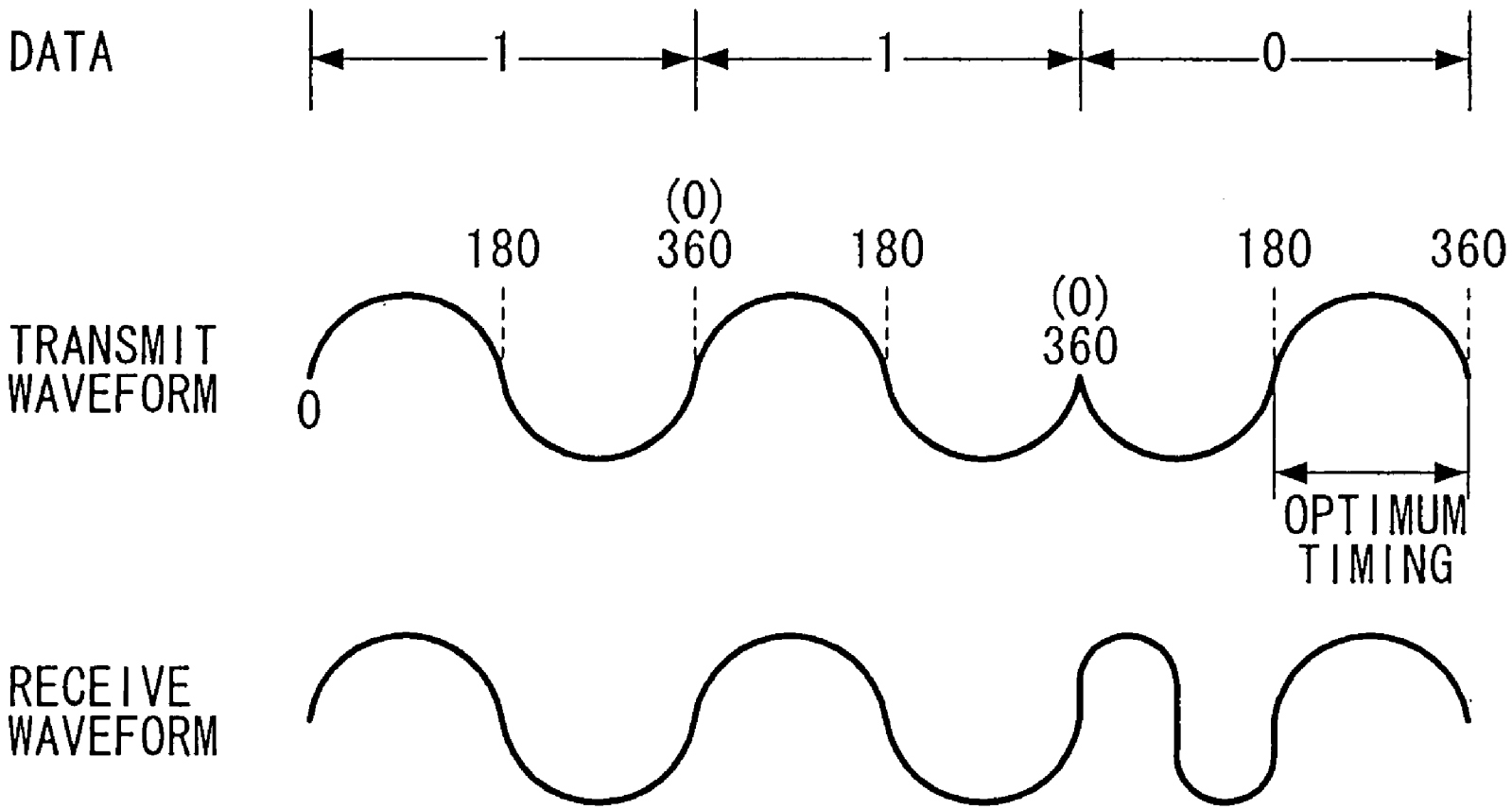
FIG. 6 is a diagram showing a relation between a transmit waveform and a receive waveform describing the chopper timing.

With reference to FIG. 6 and as described above, data signal STR is PSK-modulated, and therefore the transmitted STR data is preferably given a 0 degree phase shift when transmitting a logic high, and is preferably given a 180 degree phase shift when transmitting a logic low. Thus, the logic state of the received data signal can be determined by noting abrupt changes in the phase shift of the received signal. Thus, when data signal STR is received by the motor coil 101, an abrupt change in the phase of data signal STR is reflected in the generated voltage at node O2 when p-channel transistor is turned OFF. Since the period of the received STR signal is known, the counter can be used to select any detection point along the STR signal. As is evident from the transmit waveform and the receive waveform shown in FIG. 6, the induced, receive waveform becomes unstable during the first 180 degrees following an abrupt phase shift change (for example, in the range of 0 to 180 degrees when data changes from "1" to "0").

Consequently, it is preferable that chopper timing (which identifies the detection point, i.e. the point along the induced received STR signal where received signal STR is subjected to detection) be within a predetermined range where the induced receive waveform is not likely to be unstable. This range is identified as the "Optimum Timing" range in FIG. 6, and spans from 180 to 360 degrees. It is further preferred that the chopper timing identify a detection point on received signal STR substantially coincident with about the 270 degree point of the received STR signal. Since the mutual inductance between the motor coil 101 and the external data transmission device 105 changes in accordance to a distance between the motor coil 101 and the external data transmission device 105 Thus, the optimum phase changes. In the embodiment, the chopper timing is preferably set to coincide with the 270 degree point of received signal STR.

Here, the detection circuit 14 will be described.

Returning to FIG. 4, the detection circuit 14 comprises a reference voltage generator circuit 31, a comparator 32, and an n-channel MOS transistor N3. The reference voltage generator circuit 31 of the detection circuit 14 generates reference voltage VREF.

The n-channel MOS transistor N3, based on a sampling drive signal SSP from the control circuit 13, provides the comparator 32 with power.

When n-channel MOS transistor N3 is switched to ON state by sampling drive signal SSP, the comparator 32 compares the reference voltage VREF from reference voltage generator circuit 31 and the chopper boosted voltage Vch from output terminal O2 of the drive circuit 16, and outputs the detection data DDS. The detection data DDS is demodulated data signal STR.

[1.5] Operation of the First Embodiment

Figure 7:
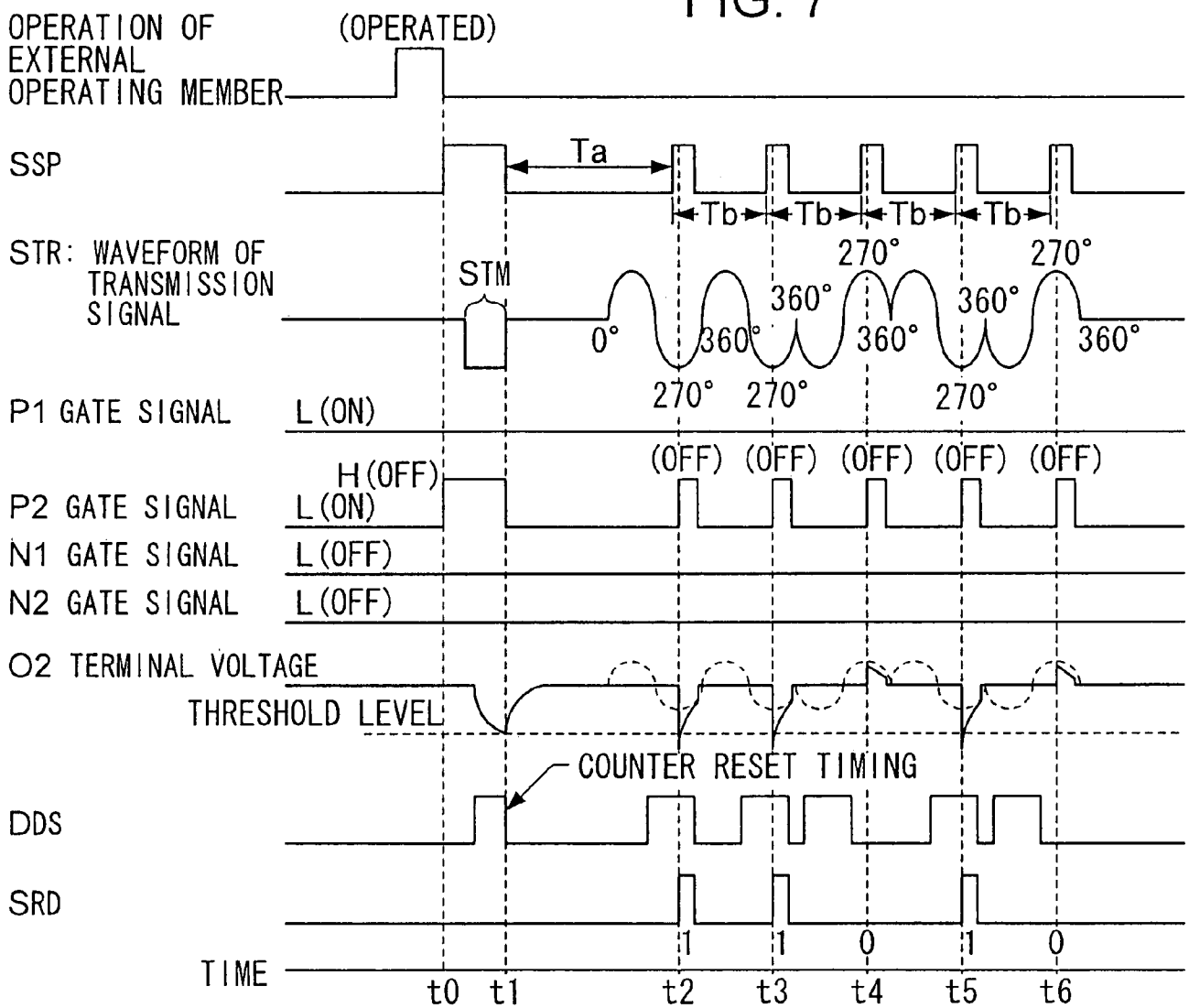
FIG. 7 is a timing chart of the analog electronic timepiece of FIG. 2.
Figure 8:
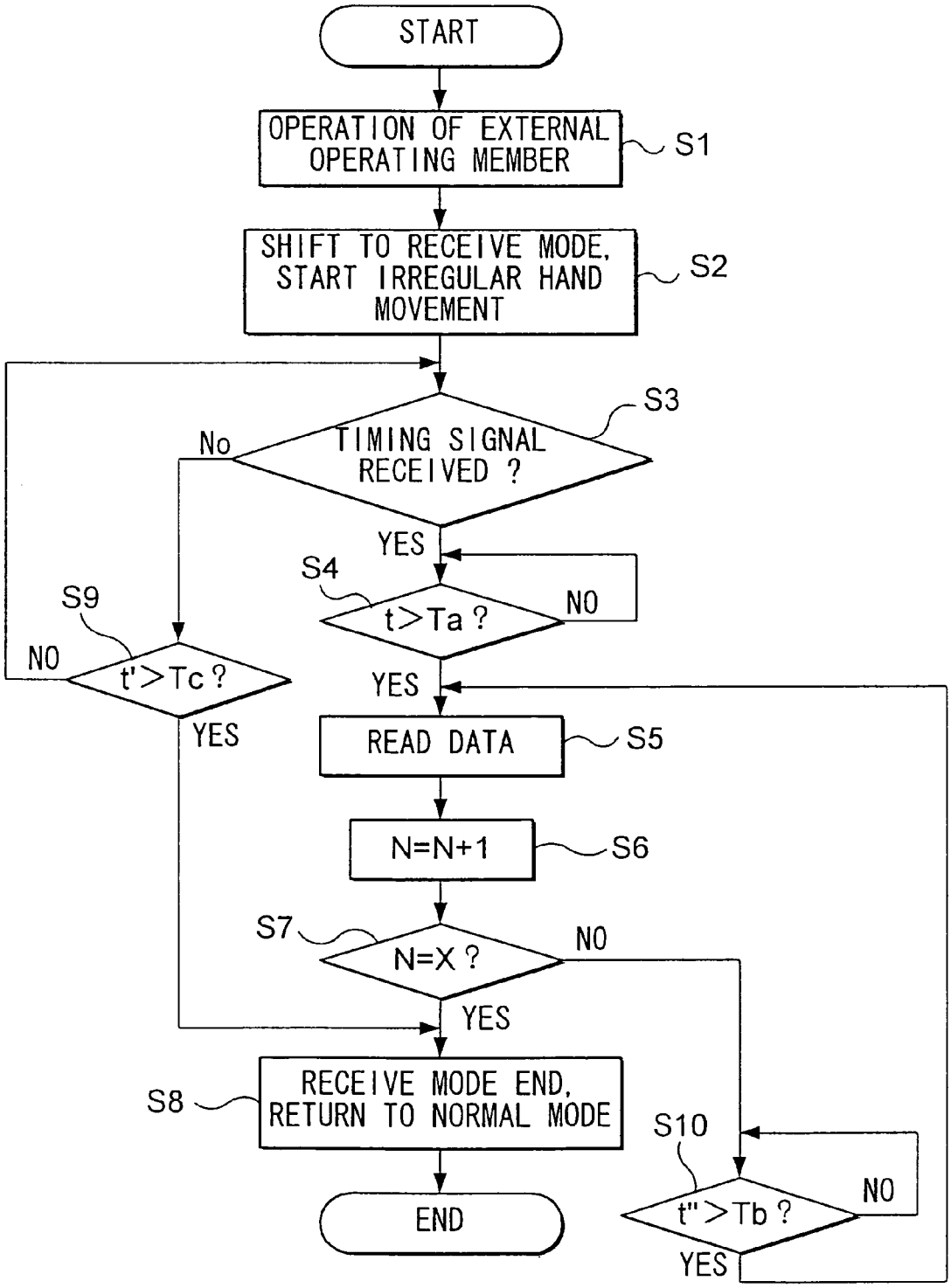
FIG. 8 is a processing flow chart of a first embodiment of FIG. 7.

Next, operation of the first embodiment will be described. FIG. 7 shows a timing chart in accord with the first embodiment. FIG. 8 shows a processing flow chart of the first embodiment. At an initial state, a data bit counter has a counter value N=1. In one receive mode, the amount of bit to be received is X bits (X is a natural number).

When data is written in the analog electronic timepiece 103, at time t0, a user operates the external operating member 102 (refer to FIG. 7) to shift the analog electronic timepiece 103 to the receive mode (step S1). In this case, in order to prevent unwanted shift to the receive mode by the user from happening, the operation of the external operating member should be complicated to some extent.

When the operation to shift to the data receive mode is carried out, the analog electronic timepiece 103 starts irregular hand movement to notify the user that the operation mode of the analog electronic timepiece is in the data receive mode (step S2).

To illustrate, in the data receive mode, for example, a five-second interval hand movement is used. In this case, during outputting drive pulse, data receiving operation cannot be carried out. In addition, during the data receive mode, it may be possible to configure to stop outputting motor pulse.

In addition, only the p-channel MOS transistor P1 is fixed to the ON state (refer to FIG. 7) during the data received mode, so outputting of the drive pulse is stopped. In addition, the p-channel MOS transistor P2 and the n-channel MOS transistors N1 and N2 is switched to OFF state (refer to FIG. 7).

As a result, as shown in FIG. 7, the output terminal O2 of the drive circuit 16 becomes high-impedance state, namely the electrically floating state.

While the output terminal O2 of the drive circuit 16 is in its high-impedance state, the sampling drive signal SSP is switched to the "H" level, the n-channel MOS transistor N3 of detection circuit 14 is also switched to ON state. By this, the comparator 32 is supplied with operating power and becomes operative, i.e. placed in its operating state.

When a magnetic field is applied to the motor coil 101 from outside, a voltage is induced around the motor coil 101.

Next, the control circuit 13 (FIG. 2) determines, on the basis of an output signal of the comparator 32, whether or not a timing signal STM (refer to FIG. 7) is received as the data signal STR via the motor coil 101 and the detection circuit 14 (step S3). In his case, it is preferable that the timing signal STM have rectangular wave that makes receive level high from the viewpoint of receive level.

As determined by step S3, when the timing signal STM is not received (step S3; NO), a determination is made whether or not an elapsed time t', which is a time from the shift to the receive mode, exceeds a predetermined stand-by time TC (step S9).

That is, step 3 determines whether or not the following inequality is satisfied;

$$t' > TC$$

As determined by step S9, if the elapsed time t' does not exceed the predetermined stand-by time TC, that is, when (step S9; NO), $$t' \leqq TC$$

the process of the flowchart returns to step S3, and the same processes is carried out.

As determined by step S9, if the elapsed time t' exceeds the stand-by time TC, in order to lower power consumption due to unnecessary operation by the comparator 32, the receive operation is stopped to return to the normal operation. Or it is assumed that the user shifted to the receive operation by mistake. Therefore, the receive operation is stopped to return to normal operation (step S8).

If step S3 determines that the timing signal STM shown in FIG. 7 is received (step S3; YES), the control circuit 13 resets the counter 13A at a rising edge of the timing signal STM as shown at t1 of FIG. 7, and causes the counter 13A to start counting operation. In addition, synchronization of the analog electronic timepiece and the external transmission device 105 is established.

Then, the analog electronic timepiece is in data receive standby state.

FIG. 7 shows operations performed after the analog electronic timepiece is synchronized with the external data transmission device. It is assumed that data signal STR transmitted from the external data transmission device 105 is "11010".

Next, the control circuit 13, based on the counted value of the counter 13A, determines whether or not the elapsed time t (which is the elapsed time from rising edge of the timing signal STM) exceeds a predetermined data detection standby time Ta (step S4).

That is, step S4 determines whether or not a following inequality is satisfied.

$$t > Ta$$

The data detection stand-by time Ta is the time period from the time of the start of transmission of data signal STR by the external data transmission device 105 to the time where a point along the received signal waveform of the first datum is at about 270 degrees with respect to itself.

During stand-by time Ta, control circuit 13 turns ON p-channel MOS transistors P1 and P2 of the driving circuit 16, and turns OFF n-channel MOS transistors N1 and N2. Consequently, p-channel MOS transistor P1, motor coil 101, and p-channel MOS transistor P2 form a closed circuit.

During this time, an induced current is generated in motor coil 101 due to data signal STR transmitted from the external data transmission device 105. The induced current passes through the p-channel MOS transistor P1, the motor coil 101, and p-channel MOS transistor P2. Consequently, motor coil 101 accumulates energy.

At step S4, when the elapsed time t does not exceed the data detection standby time Ta, step S4 operation is repeated, so the standby state is retained.

At step S4, when the elapsed time t exceeds the data detection standby time Ta, detection, i.e. reading, of data is started.

The PSK modulator circuit 25 (FIG. 3), under control of the control circuit 23, based on transmission data read from the data storage circuit 24, implements phase shift keying modulation on pulse signals output from the divider circuit to output to the amplifying circuit 26.

The amplifier circuit 26 amplifies the output of the PSK modulator circuit 25 to output as data signal STR via the transmission coil 104.

The data signal STR is a PSK-modulated sinusoidal wave. The phase of the data signal STR is inverted 180 degree based on the signal level ("H" or "L").

At this time, the analog electronic timepiece 103 puts a data read timing signal SRD to the "H" level (see FIG. 7, t2). The analog electronic timepiece 103 also determines the signal level of the detection data DDS (refer to FIG. 7), and reads data having one bit (step S5).

When the data detection stand-by time Ta elapses and at time t2, the control circuit 13 puts the gate terminal of the p-channel MOS transistor P2 to the "H" level for a short period, and puts the sampling drive signal SSP to the "H" level for a short period (FIG. 7). Consequently, the control circuit 13 turns OFF p-channel MOS transistor P2 of the driving circuit 16.

As a result, the voltage of at output terminal O2 of the driving circuit 16, namely an induced voltage, is chopper-boosted toward the negative potential side by the energy accumulated in the motor coil 101 when the p-channel MOS transistor P1, the motor coil 101, and the p-channel MOS transistor P2 were short-circuited. The dash line on terminal O2 in FIG. 7 indicates the waveform of a voltage of at output terminal O2, when it is not chopper-boosted.

Namely, when voltage Vch of the output terminal O2 is lower than the reference voltage VREF of the comparator 32, the detection data DDS is given an "H" level output.

More concretely, at time t2, the level of the detection data DDS is "H" logic level, and the data value of this one bit is therefore interpreted as a logic "1".

The pulse timing of sampling drive signal SSP (i.e. the time when SSP is switched to the "H" level) leads (i.e. is earlier than) the pulse timing (chopper timing) that places an "H" level at the gate terminal of p-channel MOS transistor P2. As explained above, this chopper timing for applying pulses at the control gate of transistor P2 is the time at which detection circuit 14 normally starts its reading operation.

Next, the control circuit 13 adds one to the data bit number counter N, that is $$N=N+1$$

is carried out (step S6). This means that N bits have already been received.

Next, step S7 determines whether or not the number of data bits received has reached X bits.

As determined by step S7, when the number of received data bits is less than X bits, that is when the following inequality is satisfied (step s7; NO), $$N<X$$

astep S10 determines whether or not an elapsed time t", which is the time from the preceding detection point for the signal level of detection data DDS (at t2) exceeds a prescribed data detection standby time Tb. Namely, whether or not a following inequality is satisfied is judged (step S10).

$$t''>Tb$$

The data detection stand-by time Tb is set to the time of one period of data signal STR transmitted from the external data transmission device 105.

When the data detection stand-by time Tb is too short, an induced current is small and it is difficult to accumulate enough energy in the motor coil 101. Consequently, the level of a chopper-boosted voltage is low. Specifically, in the case of a motor coil of an electronic timepiece, it is preferable that the data detection stand-by time Tb is about 100 μsec, or more.

If step S10 determines that the elapsed time t" does not exceeds the data detection standby time Tb, that is, determines that the following inequality is satisfied (step S10; NO), $$t''\leqq Tb$$

then the process of step S10 is repeated, and the standby state is retained.

When step S10 determines that the elapsed time t" exceed the data detection standby time Tb, the data read timing signal SRD is switched to the "H" level as shown at t3 in FIG. 7. Further, the signal level of the detection data DDS is detected, and data having one bit is read (step S5).

When the data detection stand-by time Tb elapses and at time t3, the control circuit 13 places a "H" logic level on the gate terminal of the p-channel MOS transistor P2 for a short period, and puts the sampling drive signal SSP to the "H" level for a short period. Consequently, an induced voltage Vch chopper-boosted by the driving circuit 16 is generated in the motor coil 101. The detection circuit 14 then compares the voltage (Vch) of the output terminal O2 with the reference voltage VREF, and outputs detection data DDS of data "1".

Similarly, the control circuit 13 chopper-boosts a voltage of the output terminal O2 by energy accumulated in the motor coil 101, each time the data detection stand-by time Tb elapses, which is the time of one period of data signal STR. Detection data DDS is successively outputted, which is detected as the chopper-boosted voltage (Vch) of the output terminal O2. The data conversion circuit 18 provides serial-to-parallel conversion of the detection data DDS to generate the parallel detection data DDP. The parallel detection data DDP is stored in the data storage circuit 17.

As described above, when a phase of data signal STR is at 0 degree, a voltage of the output terminal O2 is chopper-boosted to negative potential side (time t2, t3, and t5). When a phase of data signal STR has been changed by 180 degrees, a voltage of the output terminal O2 is chopper-boosted to a positive potential side. Thus, the voltage of the output terminal O2 is higher than the reference voltage VREF, and the detection circuit 14 detects detection data DDS of data "0".

In fact, voltages of the output terminals O2 and O1 are clamped by a static-shielding diode (not shown) between the max "higher electric potential side power supply Vdd+VF" and the minimum "lower electric potential side power supply Vss−VF". Thus, as shown in time t4 and t6 of FIG. 7, when a voltage of the output terminal O2 is chopper-boosted to positive potential side, only a forward voltage of the static-shielding diode is changed.

Thus, in the analog electronic timepiece 103, even if an inductive electromotive force of the motor coil 101 caused by data signal STR is small, it is possible to increase a detection level by chopper-boosting and detect detection data DDS with certainty.

In the above, PSK modulation is used. However, amplitude shift keying (ASK) modulation whose timing is adjusted so that its amplitude has its peak at data read timing signal SRD may also be used.

As determined by step S7, when the number of bits of the received data bits is X bits, that is when the following equation is satisfied, $$N=X$$

because the number of data bits to be read at one receive mode shift reaches X bits, the receive operation is stopped to return to normal operation (step S8).

Then the pace regulating circuit 19, based on the parallel detection data DDP stored in the data storage circuit 17, controls the division ratio of the divider 12 to regulate a predetermined value. Therefore, time keeping accuracy of the analog electronic timepiece is enhanced.

[1.6] Effect of the First Embodiment

As described above, the embodiment makes it possible to detect detection data DDS with certainty even if an inductive electromotive force of the motor coil 101 is small.

Thus, it is possible to perform data communication of high quality with certainty even if a metal case is used for the exterior of the analog electronic timepiece 103.

Since the analog electronic timepiece 103 can perform data communication of high quality, it is possible to write data even when the analog electronic timepiece 103 is already in the form of a finished product.

Also, data receiving is performed via a motor coil that is an integral component part of the analog electronic timepiece 103, therefore changes to the device configuration can be reduced to a minimum.

Since it is possible to shift the operation mode to the normal operation mode without operating the crown of each watch, it is possible to improve the efficiency of a working process, in which it takes much more time to manually operate the crown of each watch because the watch is set in an external data transmission device during the data receive mode.

[1.7] Modifications of the First Embodiment

[1.7.1] First Modification

In the above embodiments, data is received via the motor coil 101. When an analog electronic timepiece houses an electric generator 41, as shown in FIG. 9, a generating coil 32 of the electric generator 41 may be used instead of the motor coil 101 as a coil for receiving data.

Figure 9:
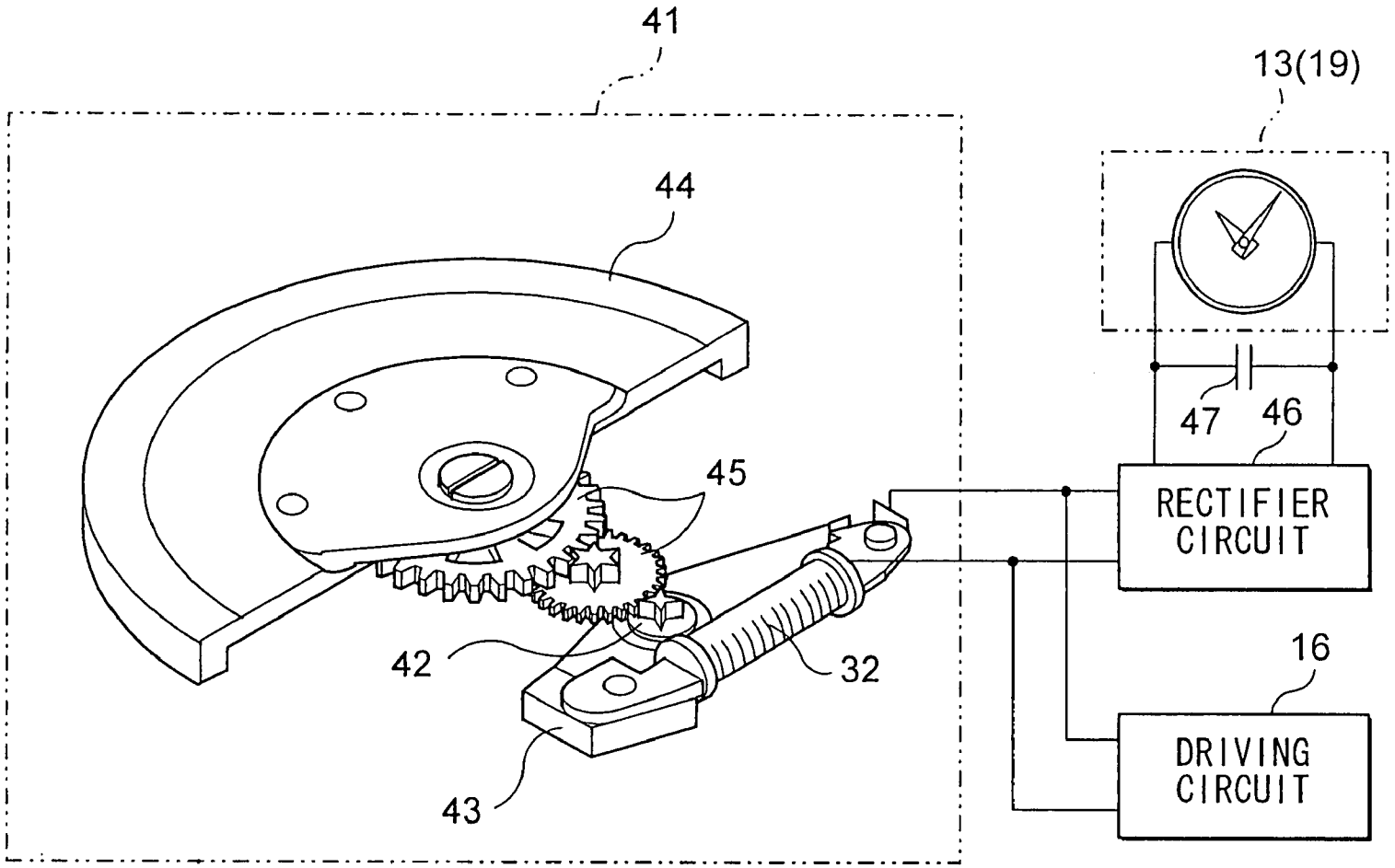
FIG. 9 is a schematic diagram showing an example of an electric generator housed in an analog electronic timepiece.

In FIG. 9, the electric generator 41 generates electrical energy from kinetic energy in the following way: A rotor 44 rotates when a user swings his/her arm wearing an electronic timepiece housing the electric generator 41. The rotation of the rotor 44 is accelerated by a gear train 45 and transferred to a rotor 42. The rotation of the rotor 42 causes an AC electromotive force to generate in the generating coil 32 of a stator 43. After an AC electromotive force generated by the electric generator 41 is half-wave rectified or full-wave rectified by a rectifier circuit 46, the resultant force is used for charging a large-capacitance capacitor 47 or supplied to the driving circuit 16.

The present invention may be applied to a method of providing another coil for receiving data as well as a method of using the motor coil 101 or the generating coil 32 as a coil for receiving data. In short, the present invention can be applied to an electronic timepiece having coils.

[1.7.2] Second Modification

In the above explanation, the input terminal of the comparator 32 is connected to the output terminal O2 which is one output terminal of the drive circuit 16. However, in actual case of an analog electrical timepiece, it is not clear which voltage is suitable on the output terminal O1 or on the output terminal O2, because of the difference of structure or state of assembling.

Therefore, in this second modification, a more suitable voltage is selected from voltage on the output terminal O1 and voltage on the output terminal O2.

Figure 10:
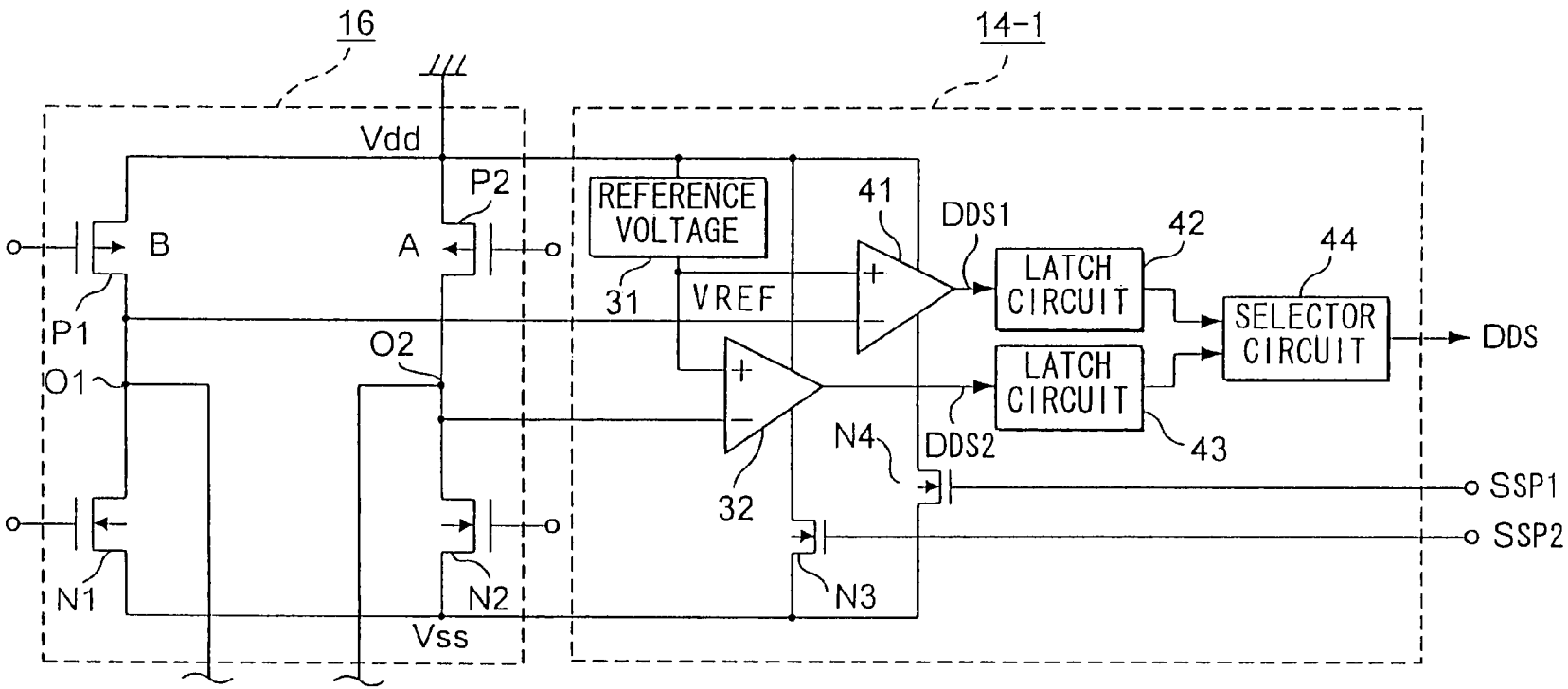
FIG. 10 is a schematic configuration block diagram of a second modification.

FIG. 10 shows a schematic configuration block diagram of the second modification. This second modification is different from the above embodiment in that, instead of the detection circuit 14 in FIG. 4, a second detection circuit 14-1 is provided. In FIG. 10, the same or identical constituents as those in FIG. 4 are shown with the similar reference characters.

The reference voltage generator circuit 31 of the detection circuit 14-1 generates reference voltage VREF.

A first comparator 41 compares reference voltage VREF with voltage Vch1 from output terminal 01 of drive circuit 16, and outputs the result as a detection data DDS1.

A second comparator 32 compares the reference voltage VREF with voltage Vch2 from output terminal O2 of drive circuit 16, and outputs the result as a detection data DDS2.

The n-channel MOS transistor N3, based on a sampling drive signal SSP2 from the control circuit 13, supplies the comparator 32 with power.

The n-channel MOS transistor N4, based on a sampling drive signal SSP1 from the control circuit 13, supplies the comparator 41 with power.

A latch circuit 42, constructed of D-flipflap circuits, latches the detection data DDS1.

A latch circuit 43, constructed of D-flipflap circuits, latches the detection data DDS2.

A selector circuit 44 selects either the detection data DDS1 or the detection data DDS2 and outputs it as the detection data DDS.

In this case, which detection data DDS1 or DDS2 the selector circuit 44 selects is determined in advance according to the target analog electronic timepiece. However, it is possible to make the selection made based on which voltage is bigger, voltage Vch1 of output terminal O1 or voltage Vch2 of output terminal O2.

Next, the detection circuit 14-1 will be described.

When output terminal O1 of drive circuit 16 enters a high-impedance state, the sampling drive signal SSP1 is switched to the "H" level. Also, the n-channel MOS transistor N4 is switched to the ON state, and comparator 41 is provided with power and becomes operative.

As a result, the comparator 41 compares voltage Vch1 on the output terminal O1 of the drive circuit 16 with reference voltage VREF and outputs the detection data DDS1 to the latch circuit 42.

In the same way, when output terminal O2 of drive circuit 16 enters a high-impedance state, the sampling drive signal SSP2 is switched to the "H" level. Also, the n-channel MOS transistor N3 is switched to the ON state, and comparator 32 is provided with power and becomes operative.

The comparator 32 compares the reference voltage VREF and voltage Vch2 from output terminal O2 of the drive circuit 16, and outputs the detection data DDS2 to latch circuit 43.

As a result of this, latch circuit 42 holds the detection data DDS1, latch circuit 43 holds the detection data DDS2.

The selector circuit 44 selects a latch circuit in a predecided way to select either the detection data DDS1 or the detection data DDS2. Then the selector circuit 44 outputs a detection data corresponding to the selected latch circuit as the detection data DDS.

In this way, since either voltage of output terminals O1 or O2 can be a target of the detection data DDS, suitable detection can be carried out for each analog electronic timepiece regardless its size and structure.

[1.7.3] Third Modification

In the above explanation, the comparator 32 is used to detect the detection data DDS. However, instead of the comparator 32, an inverter circuit may be used.

By this, circuit structure can be simplified. But, the reference voltage VREF1, which is threshold for detection, is preferably set to, $$VREF1 \approx (Vdd - VSS)/2$$

Therefore, degree of freedom for setting threshold level is reduced.

Figure 11:
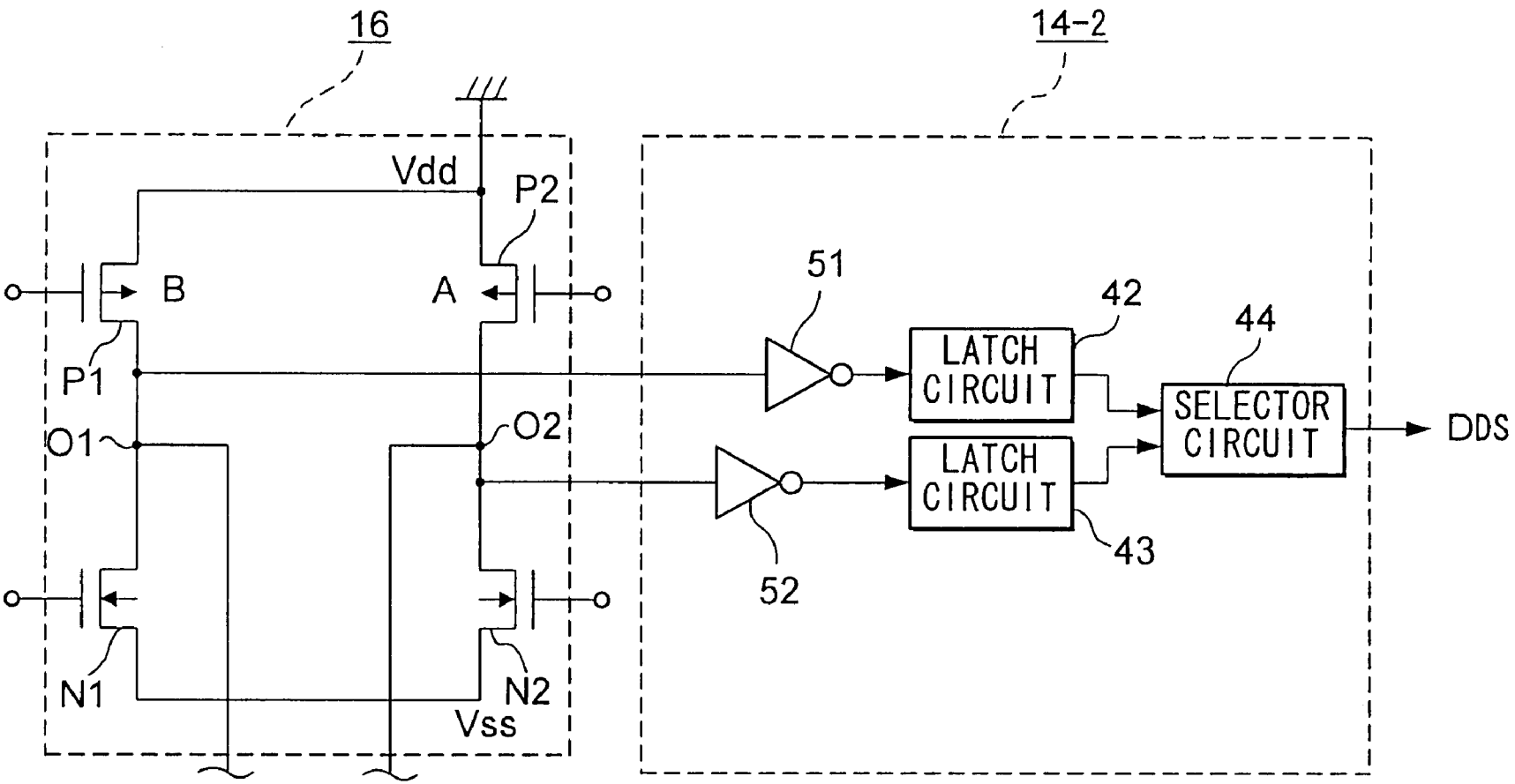
FIG. 11 is a schematic configuration block diagram of a third modification.

To illustrate, FIG. 11 is a schematic configuration block diagram of this third modification. This third modification is different from the above embodiment in that, instead of the detection circuit 14-1 in FIG. 10, a detection circuit 14-2 is provided. In FIG. 10, the same or identical constituents as or to those in FIG. 11 are shown with the same reference characters.

An inverter circuit 51 of the detection circuit 14-2 compares voltage Vch1 on the output terminal O1 of the drive circuit 16 with reference voltage VREF1 and outputs the detection data DDS1.

An inverter circuit 52 compares voltage Vch2 on the output terminal O2 of the drive circuit 16 with reference voltage VREF1 and outputs the detection data DDS2.

A latch circuit 42, constructed of D-flipflap circuits, latches the detection data DDS1.

A latch circuit 43, constructed of D-flipflap circuits, latches the detection data DDS2.

A selector circuit 44 selects either the detection data DDS1 or the detection data DDS2 and outputs it as the detection data DDS.

In this case too, as in the first modification, which of detection data DDS1 or DDS2 is selected by selector circuit 44 is determined in advance according to the target analog electronic timepiece. However, it is possible to make the selection based on which voltage is bigger voltage Vch1 of the output terminal O1 or voltage Vch2 of the output terminal O2.

In the above, PSK modulation is used. However, amplitude shift keying (ASK) modulation whose timing is adjusted so that its amplitude has its peak at data read timing signal SRD may be used.

Next, outlined operation of the detection circuit 14-2 will be described.

The inverter circuit 51 outputs a detection data DDS1 that indicates whether voltage Vch1 on the output terminal O1 of the drive circuit 16 exceeds the threshold voltage VREF1 for the inverter circuit 51 to the latch circuit 42.

In the same way, the inverter circuit 52 outputs a detection data DDS2 20 that indicates whether voltage Vch2 on the output terminal O2 of the drive circuit 16 exceeds the threshold voltage VREF2 for the inverter circuit 51 to the latch circuit 43. When the inverter circuits 51, and 52 are made in integrated circuit, the threshold voltages VREF1 and VREF2 can be made almost same.

As a result of this, the latch circuit 42 holds the detection data DDS1, and the latch circuit 43 holds the detection data DDS2.

The selector circuit 44 selects a latch circuit in a predecided way to select either the detection data DDS1 or the detection data DDS2. Then the selector circuit 44 outputs a detection data corresponding to the selected latch circuit as the detection data DDS.

In this way, it becomes possible to simplify the configuration of the detection circuit. Moreover, as in the second modification, either voltage of output terminals O1 or O2 can be the detection data DDS. As a result, it becomes possible to make a suitable detection for each analog electronic timepiece regardless its size and structure.

[1.7.4] Fourth Modification

In the first embodiment, shift to the data receive mode is conducted based on the operating state of the external operating member 102. However, in the fourth modification, shift to the data receive mode is automatically conducted in a motor pulse non-outputting period. The motor pulse non-outputting period is a period between two consecutive motor pulses.

Figure 12:
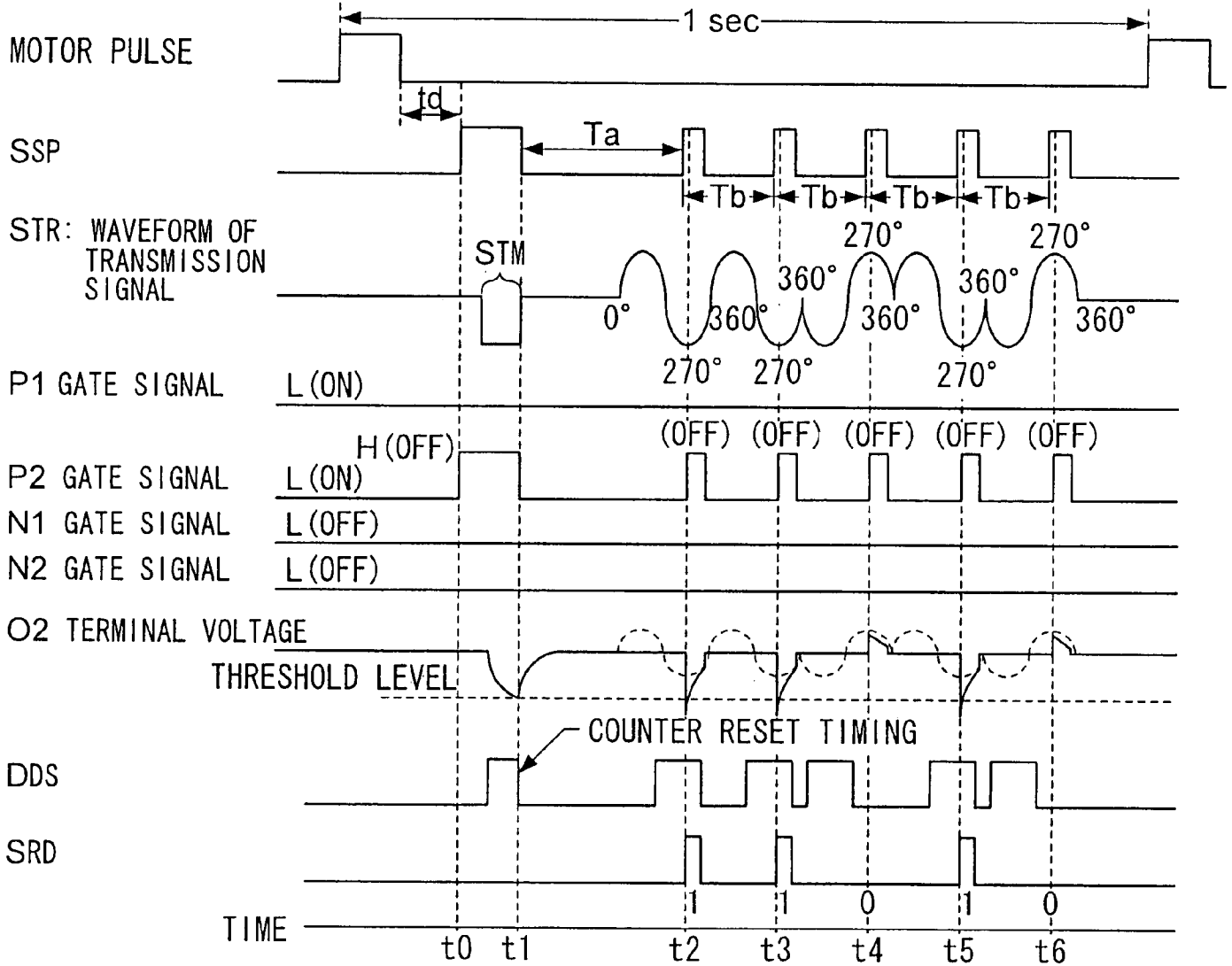
FIG. 12 is a timing chart of a fourth modification.

FIG. 12 shows a timing chart of the fourth modification.

Motor pulses are output at intervals of one second (refer to FIG. 12). At time t0 where a prescribed time Td has passed from an output completion timing of a motor pulse, the sampling drive signal SSP is switched to the "H" level (refer to FIG. 12).

By this, the analog electronic timepiece is shifted to the data receive mode, and only the p-channel MOS transistor P1 is put to ON state (refer FIG. 12). In addition, output of the drive pulses is stopped. By this, the p-channel MOS transistor P2, the n-channel MOS transistor N1, and the n-channel MOS transistor N2 are put to the OFF state (refer to FIG. 12).

As a result, the output terminal O2 of the drive circuit 16 becomes high-impedance state, or floating state as shown in part H of FIG. 12.

Therefore, by applying magnetic field to the motor coil 101 from the outside, voltage is induced around the motor coil 101.

Concurrently with becoming high-impedance state of the output terminal O2 of the drive circuit 16, the sampling drive signal SSP is switched to the "H" level (refer to FIG. 7). The n-channel MOS transistor N3 is also switched to the ON state. By this, the comparator 32 is supplied with operating power and becomes operative.

Next, the control circuit 13 determines whether or not a timing signal STM (refer FIG. 12) is received as the data signal STR via the motor coil 101 and the detection circuit 14.

When a timing signal as shown in FIG. 12 is received, the control circuit 13 starts its counting operation. In addition-ally shown, time t1 in FIG. 12, at a rising edge of the timing signal STM, the counter 13 is reset. A synchronization is established between the analog electronic timepiece and the external data transmission device 105, and the analog electronic timepiece is put to the data receive standby state.

Next, the control circuit 13, based on the counted value of the counter 13A, determines whether or not an elapsed time t that is a time extending from rising edge of the timing signal STM to the present exceeds a predetermined data detection standby time Ta.

That is, whether or not a following inequality is satisfied is judged.

$$t>Ta$$

The data detection stand-by time Ta is the time between the timing of the external data transmission device 105 starting to transmit data signal STR, and the timing of a phase of a signal waveform of the first data being at about 270 degrees.

At this point, the control circuit 13 turns the p-channel MOS transistors P1 and P2 of the driving circuit 16 to on state, and turns the n-channel MOS transistors N1 and N2 to off state. Consequently, the p-channel MOS transistor P1, the motor coil, and the p-channel MOS transistor P2 are short-circuited.

In this case, an induced current passes through the motor coil 101 due to data signal STR transmitted from the external data transmission device 105, and the induced current passes through the p-channel MOS transistor P1, the motor coil 101, and p-channel MOS transistor P2. Consequently, an inductance of the motor coil 101 accumulates energy.

When the elapsed time t exceeds the data detection standby time Ta, transmission of data is started.

The PSK modulator circuit 25, under control of the control circuit 23, based on transmission data read from the data storage circuit 24, implements phase shift keying modulation on pulse signals output from the divider circuit to output to the amplifying circuit 26.

The amplifier circuit 26 amplifies the output of the PSK modulator circuit 25 to output as data signal STR via the transmission coil 104.

The data signal STR is a PSK-modulated sinusoidal wave. The phase of the data signal STR is inverted 180 degree based on the signal level ("H" or "L").

At this time, the analog electronic timepiece 103 puts a data read timing signal SRD to the "H" level (see FIG. 12, t2). The analog electronic timepiece 103 also determines the signal level of the detection data DDS (refer to part I of FIG. 12), and reads data having one bit (step S5).

When the data detection stand-by time Ta elapses and at time t2, the control circuit 13 puts the gate terminal of the p-channel MOS transistor P2 to the "H" level for a short period, and puts the sampling drive signal SSP to the "H" level for a short period (FIG. 12). Consequently, the control circuit 13 turns the p-channel MOS transistor P2 of the driving circuit 16 to off state.

As a result, a voltage of the output terminal O2 of the driving circuit 16, namely an induced voltage, is chopper-boosted to negative potential side by the energy accumulated in an inductance of the motor coil 101 when the p-channel MOS transistor P1, the motor coil 101, and the p-channel MOS transistor P2 are short-circuited. The dashed line of FIG. 12 along terminal O2 shows the waveform of a voltage at output terminal O2 when it is not chopper-boosted.

Namely, when the induced terminal voltage Vch on the output terminal O2 becomes lower than the reference voltage VREF, the detection data DDS having the "H" level is output.

More concretely, at time t2, the detection data becomes the "H" level, and one bit data has "1".

A timing of putting the sampling drive signal SSP to the "H" level, is earlier than a timing (chopper timing) of putting the gate terminal of the p-channel MOS transistor P2 to the "H" level, which is the time until when the detection circuit 14 normally starts a reading operation.

Next, the control circuit 13 adds one to value of a data bit number counter N, that is $$N=N+1$$

is carried out. This means that data having N bits is already received.

Next, a determination is made as to whether or not the number of bits of the received data reaches X bits.

As a result of this determination, when the number of bits of the received data is less than X bits, that is when the following inequality is satisfied, $$N<X$$

a determination is made as to whether or not an elapsed time t", which is a time from a preceding detection point of signal level of detection data DDS (at t2), exceeds a prescribed data detection standby time Tb. Namely, whether or not a following inequality is satisfied is judged.

$$t''>Tb$$

The data detection stand-by time Tb is set to the time of one period of data signal STR transmitted from the external data transmission device 105.

When the data detection stand-by time Tb is too short, an induced current is small and it is impossible to accumulate enough energy in the motor coil 101. Consequently, the level of a chopper-boosted voltage is low. Specifically, in the case of a motor coil of an electronic timepiece, it is preferable that the data detection stand-by time Tb is about 100 μsec or more.

When the elapsed time t" does not exceeds the data detection standby time Tb, that is the following inequality is satisfied, $$t''\leqq Tb$$

the standby state is retained.

On the other hand, when the elapsed time t" exceeds the data detection standby time Tb, the data read timing signal SRD is put to the "H" level as shown at t3 in FIG. 12. Further, the signal level of the detection data DDS is detected, and data having one bit is read.

When the data detection stand-by time Tb elapses and at time t3, the control circuit 13 puts the gate terminal of the p-channel MOS transistor P2 to the "H" level for a short period, and puts the sampling drive signal SSP to the "H" level for a short period, an induced voltage Vch chopper-boosted by the driving circuit 16 is generated in the motor coil 101. The detection circuit 14 then compares the voltage (Vch) of the output terminal O2 with the reference voltage VREF, and outputs detection data DDS of data "1".

Similarly, the control circuit 13 chopper-boosts a voltage of the output terminal O2 by energy accumulated in the motor coil 101, each time the data detection stand-by time Tb elapses, which is the time of one period of data signal STR. Detection data DDS is successively outputted, which is detected from the chopper-boosted voltage (Vch) of the output terminal O2. The data conversion circuit 18 applies serial-to-parallel conversion to the detection data DDS to generate a parallel detection data DDP. The parallel detection data DDP is stored in the data storage circuit 17.

As described above, when a phase of data signal STR is 0 degree, a voltage of the output terminal O2 is chopper-boosted to negative potential side (time t2, t3, and t5). When a phase of data signal STR has been changed by 180 degrees, a voltage of the output terminal O2 is chopper-boosted to a positive potential side. Thus, the voltage of the output terminal O2 is lower than the reference voltage VREF, and the detection circuit 14 detects detection data DDS of data "0".

In fact, voltages of the output terminals O2 and O1 are clamped by a static-shielding diode (not shown) between the max "higher electric potential side power supply Vdd+VF" and the minimum "lower electric potential side power supply Vss−VF". Thus, as shown in time t4 and t6 of FIG. 12, when a voltage of the output terminal O2 is chopper-boosted to positive potential side, only a forward voltage of the static-shielding diode is changed.

Thus, in the analog electronic timepiece 103, even if an inductive electromotive force of the motor coil 101 caused by data signal STR is small, it is possible to increase a detection level by chopper-boosting and detect detection data DDS with certainty.

[1.7.5] Fifth Modification

In the processing flow chart in FIG. 8, when a prescribed amount of data is received, the data receive mode is terminated. However, the data receive mode may also be terminated when a prescribed termination order is received.

Figure 13:
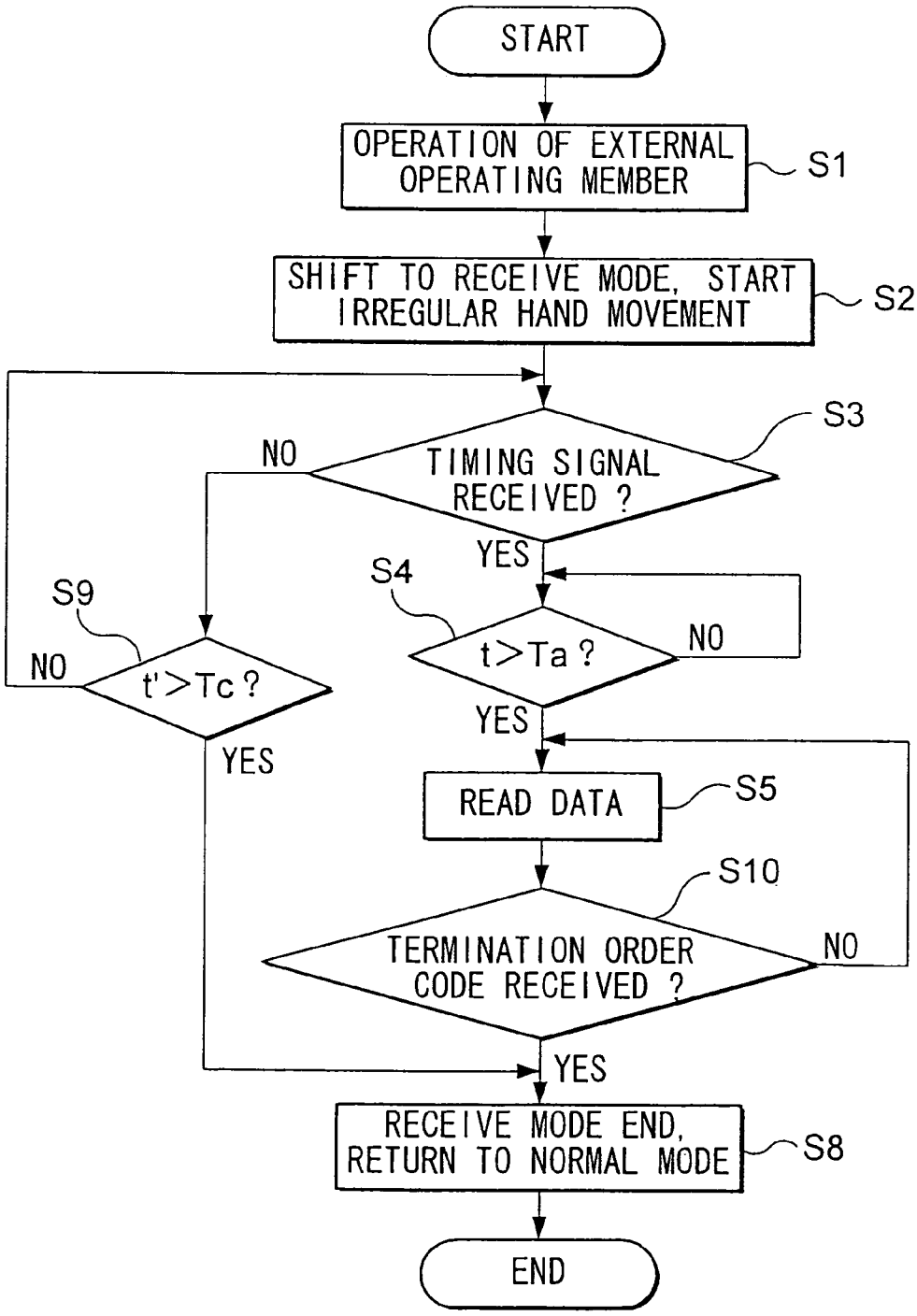
FIG. 13 is a processing flow chart of a fifth modification.

FIG. 13 shows a processing flow chart of a fifth modification. The processing in processing flow chart shown in FIG. 13 is as a general similar to the processing in processing flow chart of FIG. 8.

Difference from the processing flow chart of FIG. 8 is that, after data receive operation, when the received data is a termination order code, the receive mode is terminated and the normal mode is resumed.

In this case, a termination order code, for example as shown if FIG. 14, may be configured to have a data command queue with an order code section having four bits and a data section having eight bits.

A termination order code has "0101" in its order code section and dummy data in its data section.

When data A is transmitted, the order code section has "1001" and the data section has data for data A.

When data B is transmitted, the order code section has "1010" and the data section has data for data B.

When data C is transmitted, the order code section has "1011" and the data section has data for data C.

As a result, the analog electronic timepiece which received the termination order code shifts its operation mode to the normal operation mode, and normal hand movement is resumed. Since it is possible to shift the operation mode to the normal operation mode without operating the crown of each watch, it is possible to improve the efficiency of a working process, in which it takes much more time to manually operate the crown of each watch because the watch is set in an external data transmission device during the data receive mode.

[1.7.6] Sixth Modification

Figure 15:
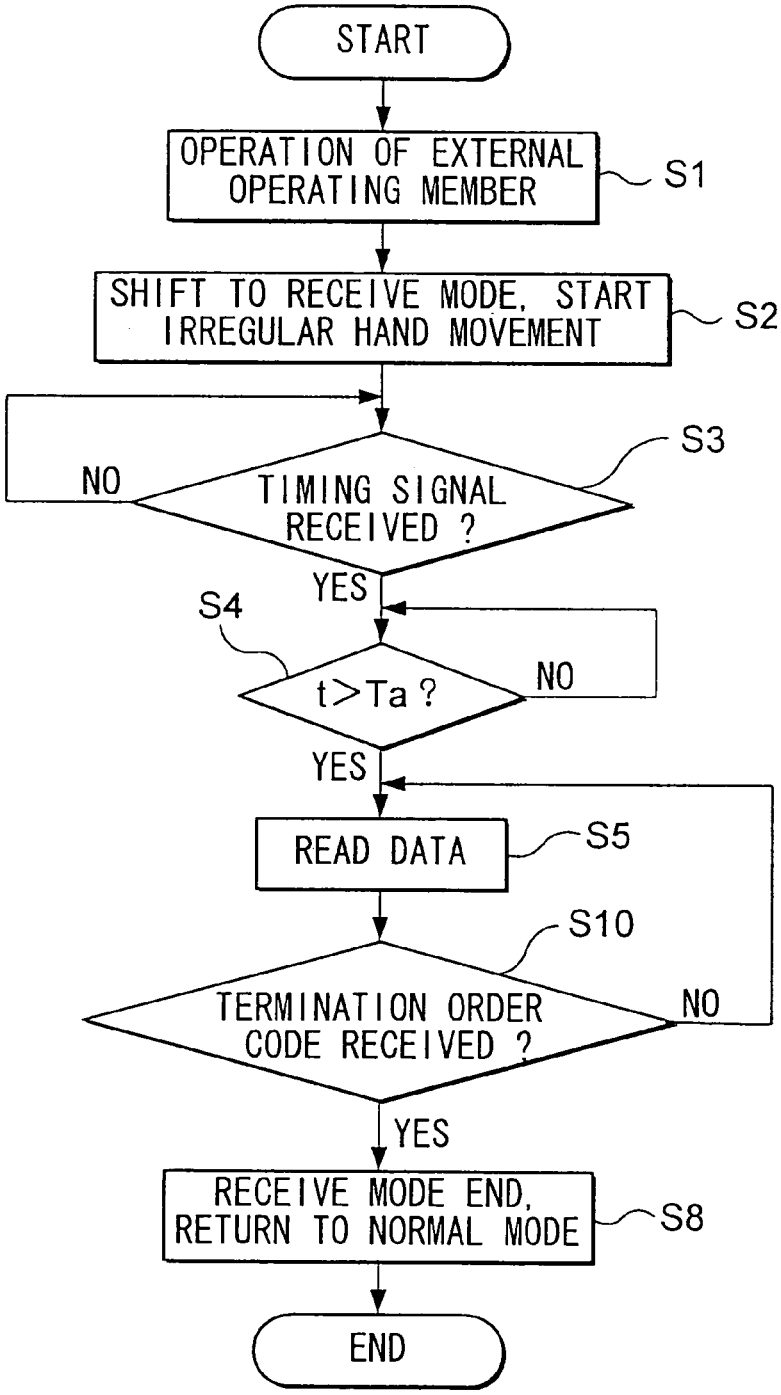
FIG. 15 is a processing flow chart of a sixth modification.

FIG. 15 shows a processing flow chart of a sixth modification.

In the processing flow chart in FIG. 8, when the timing signal STM is not received within the stand-by time TC (step S9) or when a prescribed amount of data is received (step S6), the data receive mode is terminated.

On the other hand, in the sixth modification shown in FIG. 15, step S9 is deleted. In the present modification, namely, only when the received data is a termination order code after data receive operation (step S10), the receive mode is terminated and the normal mode is resumed.

A termination order code in the sixth modification is similar to the termination order code shown in the fifth modification.

It is possible to combine with the configuration of the sixth modification, configurations of the above-mentioned first embodiment, its modifications, and a second embodiment later described.

As a result, because an analog electronic timepiece shifts its operation mode from the data receive mode to the normal mode when receiving the termination order code, an external data transmission device can transmit the termination order code at any given time during the data receive mode, for example, in a production inspection process of a manufacturing factory. Thus, it is possible to shift the operation mode according to the production inspection process. Therefore, it is possible to optimally shift the operation mode in terms of the reliability of a data exchange and production efficiency. If necessary, it is possible to hold the data receive mode for a long time, and it becomes easier to automatically shift the operation mode without the control of an operator.

[2] Second Embodiment

[2.1] Schematic Configuration of a Data Transmission System

Next, a second embodiment of the data transmission system will be described.

In the above first embodiment of the data transmission system, what is possible is only that the external data transmission device transmits data to the analog electronic timepiece. However, in the second embodiment of the data transmission system, the external data transmission device and the analog electronic timepiece can transmit and receive in two-way.

Figure 16:
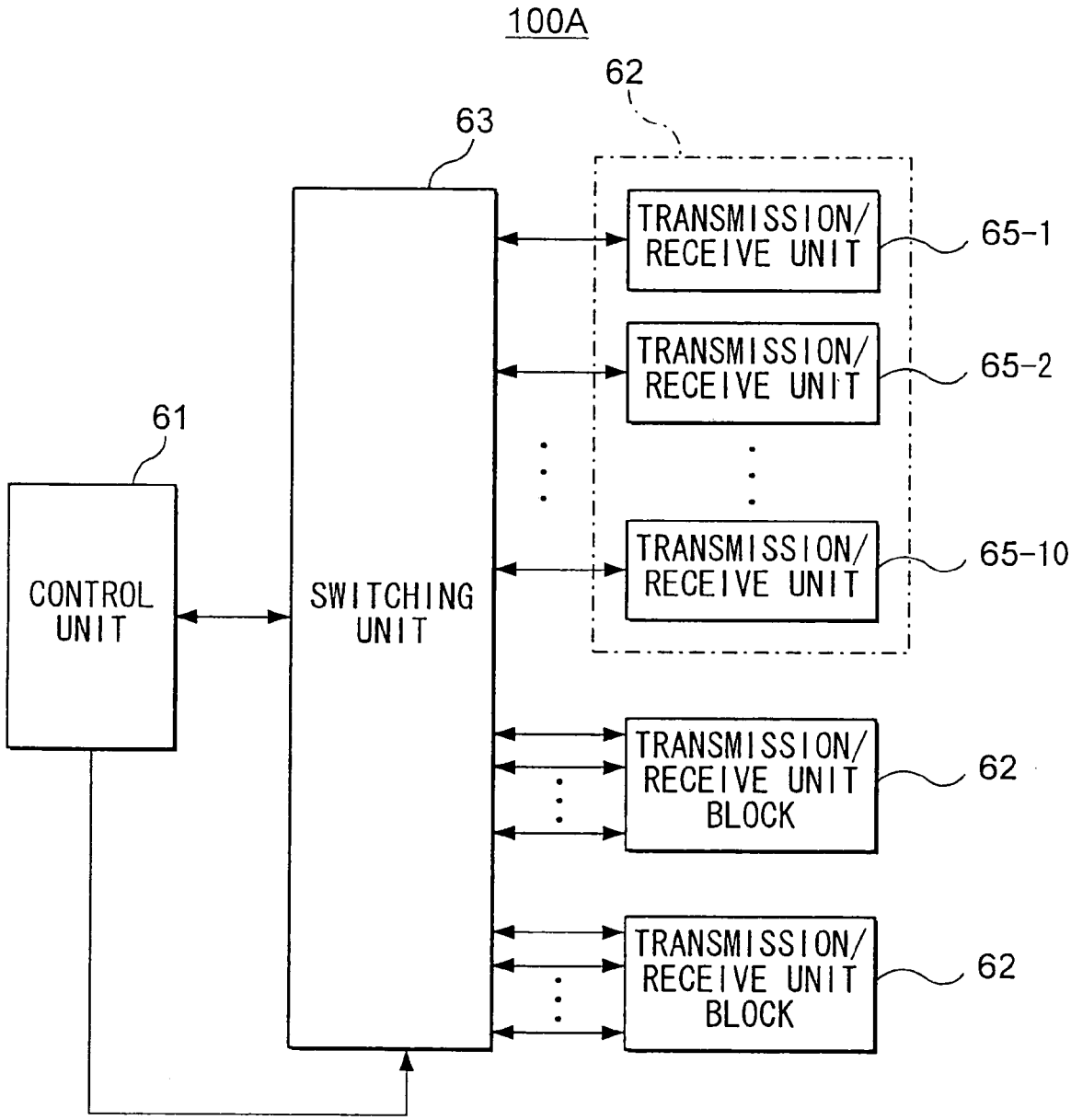
FIG. 16 is a schematic configuration block diagram of a data transmission system of the second embodiment.

FIG. 16 shows a schematic configuration block diagram of a data transmission system of the second embodiment. The data transmission system 100A essentially includes a control unit 61, a transmission/receive unit block 62, and a switching unit 63. A plurality of analog electronic timepieces 103 (not shown) are arranged in a manner as shown in FIG. 18, each facing a corresponding one transmission/receive units 65-1 to 65-10 within each transmission/receive unit block 62. The control unit 61 controls all parts of the data transmission system. Each of the transmission/receive unit blocks 62 transmits and receives data between the analog electronic timepiece 103.

In this case, the transmission/receive unit block 62 comprises a plurality of (in FIG. 16, 10 units of) transmission/receive units 65-1 to 65-10 which are simultaneously driven. Therefore, one transmission/receive unit block 62 performs data transmission and receive operation between ten analog electronic timepieces simultaneously. The switching unit 63, under control of the control unit 61, switches to the transmission/receive unit block 62 which is to be controlled.

Figure 17:
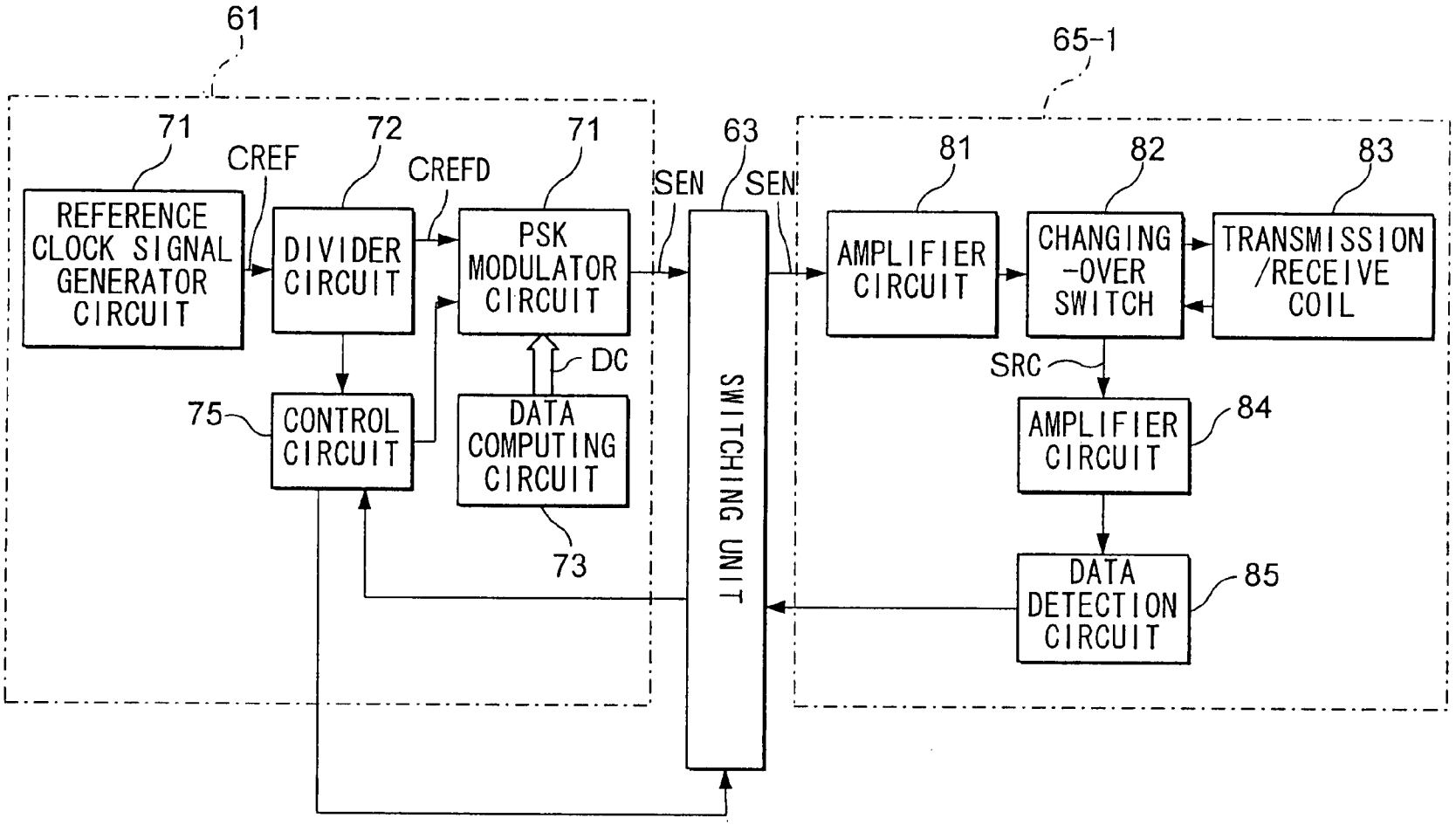
FIG. 17 is a schematic configuration block diagram of a control unit and a transmit/receive unit of the second embodiment.

FIG. 17 shows a schematic configuration block diagram of a control unit 61 and a transmission/receive unit 65-1. Since all transmission/receive units 65-1 to 65-10 within transmission/receive unit blocks 62 have the same configuration, in the following explanation, only the transmission/receive unit 65-1 will be described as an example.

A reference clock signal generator circuit 71 generates a reference clock signal CREF. A divider circuit 72 divides the reference clock signal CREF, thereby outputs a divided clock signal CREFD. A data computing circuit 73, based on a measurement data (for example, a pace measurement data), calculates and outputs a correction data DC.

A phase shift keying (PSK) modulator circuit 71, based on the correction data DC and the divided clock signal CREFD, implements PSK modulation and outputs a modulated signal SEN to the switching unit 63. The control circuit 75 controls all parts of the control unit 61 and, by means of a switch control signal SSW, also control at least part of switching unit 63.

Next, the transmit/receive unit 65-1 will be described. An amplifying circuit of the transmit/receive unit 65-1 amplifies the modulating signal SEN which is input via the switching unit 63. The changing-over switch 82 switches between transmission and receiving. A transmission/receive coil 83 transmits and receives data with its corresponding analog electronic timepiece. An amplifying circuit 84 amplifies a receive signal SRC which is received from the analog electronic timepiece via the transmission/receive coil 83.

A data detection circuit 85 extracts transmitted data from the output signal of the amplifying circuit 84, and outputs it to the control unit 61 via the switching unit 63.

When data transmit and receive is performed in a practical manner, the analog electronic timepiece 103 is, as shown in FIG. 18, in a finished product state of assembled in a case and placed near the transmission/receive coil 83, and performs data transmission and receive by using magnetic field signal.

Next, outlined operation will be descried.

First, one case in which the control unit 61 transmits data to the analog electronic timepiece 103 will be described.

The reference clock signal generator circuit 71 of the control unit 61 generates a reference clock signal CREF and outputs it to the divider circuit 72. The divider circuit 72 divides the reference clock signal CREF and outputs a divided clock signal CREFD to the PSK modulator circuit 74. A data computing circuit 73, under control of control circuit 75, based on a measurement data, calculates a correction data DC and outputs the result to the PSK modulator circuit 74.

As a result of these, the PSK modulator circuit 74, based on the correction data DC and the divided clock signal CREFD, implements PSK modulation and outputs a modulating signal SEN to the switching unit 63.

The switching unit 63 connects the control unit 61 to the transmit/receive unit 65-1 on which the analog electronic timepiece 103 which is to receive the modulating signal SEN is placed.

As a result, the amplifying circuit 81 of the transmit/receive unit 65-1 amplifies the modulating signal SEN which is input via the switching unit 63, then outputs it to the transmission/receive coil 83 via the changing-over switch 82.

Then data is transmitted to the analog electronic timepiece 103 via the transmission/receive coil 83.

Next, operation of a case in which the analog electronic timepiece 103 transmits data to the control unit 61 will be described.

When the analog electronic timepiece 103 transmits toward the control unit 61 data from the motor coil by motor pulse, the receive signal SRC is input to the amplifying circuit 84 via the transmission/receive coil 83.

The amplifying circuit 84 amplifies the receive signal and outputs it to the data detection circuit 85.

These operations are performed by each of the transmit/receive unit which makes up transmit/receive unit block. Therefore, a lot of analog electronic timepieces can be adjusted at one time.

[3] Modifications of the Embodiments

[3.1] First Modification

In the above explanation, an explanation is given of a case where a motor coil is used for data transferring as an example. However, the present invention may be applied to other timepiece such as a digital timepiece, if an electrical timepiece has a coil that is not limited to a motor coil and can be used for non-contact communication.

[3.2] Second Modification

In the above explanation, only one transmission is carried out for one data item. However, in order to enhance reliability of data reception of the analog timepiece, it is possible to configure such that one data signal is received multiple times repeatedly, and only when the analog electrical timepiece receives one data signal multiple times writing data is carried out.

[3.3] Third Modification

In the above explanation, an explanation is given of an analog electrical timepiece that has analog hands only. However, the present invention may be applied to a digital timepiece that carries out digital displaying and to an analog electrical timepiece with a digital display, which analog electrical timepiece may display on its liquid crystal display a result of measurement by sensors for various measurements.

[3.4] Fourth Modification

In the above explanation, an explanation is given of an analog electrical timepiece. However, the intention of the present invention may be applied to a handheld electrical device with a motor coil other than an analog electrical timepiece, such as a portable CD player, a portable mini disc (MD) player or recorder, a portable cassette player or recorder.

[3.5] Fifth Modification

In the above explanation, a configuration is adopted in which shift to the data receive mode is carried out based on an operating condition of the external operating member 102 or a non-output time period of the motor pulse. However, it is possible to provide a conduction terminal at an indistinctive place and input electrical signal by bring it into contact with a probe. Also, it is possible to provide a photo acceptance unit and, by inputting optical signal having a prescribed pattern to the photo acceptance unit, make a shift to the data receive mode.

[4] Effect of the Embodiments

According to the present invention, because data is received via a coil, it becomes possible to write data easily after assembling timepieces.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An electronic timepiece with a coil comprising:

a signal input unit for inputting a signal in response to an external operation;

a mode setting unit for switching, in response to the signal, an operation mode of the electronic timepiece between a data receive mode and a normal operation mode;

a synchronization signal generating unit for generating, when the operation mode is in the data receive mode, an internal synchronization signal that is synchronized to an external synchronization signal transmitted from an external transmitting device;

a received data recovery unit for recovering, when the operation mode is in the data receive mode, received data on the basis of the internal synchronization signal and a data voltage signal induced across the coil by a transmitted data signal from the external transmitting device, and for outputting the received data; and an operation control unit for placing the received data recovery unit in an operation enabled state only during a prescribed time period while the electronic timepiece is in the data receive mode.

2. An electronic timepiece as claimed in claim 1, wherein the coil is a motor coil.

3. An electronic timepiece as claimed in claim 1, wherein the mode setting unit shifts the operation mode to the data receive mode when a signal input via the signal input unit is a prescribed signal.

4. An electronic timepiece as claimed in claim 3, wherein:

the signal input unit comprises an external operation unit capable of being placed in various operating conditions by which a user performs various operations; and the signal input unit applies the prescribed signal to the mode setting unit when the operating condition of the external operation unit is in a prescribed operating condition.

5. An electronic timepiece as claimed in claim 3, wherein:

the coil is a motor coil; and the electronic timepiece further comprises a motor drive pulse output prohibit unit for prohibiting an application of motor drive pulses to the motor coil when the operation mode is in the data receive mode.

6. An electronic timepiece as claimed in claim 3, wherein the mode setting unit shifts the operation mode from the data receive mode to the normal operation mode when the external synchronization signal is not received within a prescribed time period after the operation mode is shifted to the data receive mode.

7. An electronic timepiece as claimed in claim 3, wherein the mode setting unit shifts the operation mode from the data receive mode to the normal operation mode when data having a predetermined amount of bits is received after the operation mode is shifted to the data receive mode.

8. An electronic timepiece as claimed in claim 1, wherein:

the coil is a motor coil;

motor drive pulses are sent to the motor coil at regular intervals; and the mode setting unit sets the operation mode to the data receive mode only during a no-drive-pulse time period of predetermined duration during which motor drive pulses are not sent to the motor pulse.

9. An electronic timepiece as claimed in claim 1, further comprising:

a received data storage unit for storing the received data; and a data storage control unit for, when a prescribed number of identical data is received, storing the received data into the received data storing unit.

10. An electronic timepiece as claimed in claim 9, wherein the received data storage unit comprises:

a non-volatile memory unit for storing the received data in a nonvolatile manner; and a data writing unit for writing the received data to the non-volatile memory unit.

11. An electronic timepiece as claimed in claim 1, wherein the received data recovery unit comprises a comparator for recovering and outputting the received data by comparing a voltage level of the data voltage signal with a prescribed reference voltage.

12. An electronic timepiece as claimed in claim 1, wherein:

the received data recovery unit comprises a comparator for recovering and outputting the received data by comparing a voltage level of the data voltage signal with a prescribed reference voltage; and wherein the operation control unit places the comparator in the operation enabled state only during the prescribed time period during the data receive mode.

13. An electronic timepiece as claimed in claim 11, further comprising a power supply control unit for supplying operating power to the comparator only during the prescribed time period while the electronic timepiece is in the data receive mode.

14. An electronic timepiece as claimed in claim 1, wherein the received data recovery unit comprises an inverter for recovering and outputting the received data by comparing a voltage level of the data voltage signal with a prescribed reference voltage.

15. A system for regulating an electronic timepiece on the basis of data signals transmitted from an external transmitting device, the system comprising:

the electronic timepiece; and the external transmitting device, wherein the electronic timepiece includes:

a coil;

a signal input unit for inputting a signal in response to an external operation;

a mode setting unit for switching, in response to the signal, an operation mode of the electronic timepiece between a data receive mode and a normal operation mode;

a synchronization signal generating unit for generating, when the operation mode is in the data receive mode, an internal synchronization signal that is synchronized to an external synchronization signal transmitted from the external transmitting device;

a received data recovery unit for recovering, when the operation mode is in the data receive mode, received data on the basis of the internal synchronization signal and a data voltage signal induced across the coil by a transmitted data signal from the external transmitting device, and for outputting the received data; and an operation control unit for placing the received data recovery unit in an operation enabled state only during a prescribed time period while the electronic timepiece is in the data receive mode;

wherein the external transmitting device includes a transmitter unit for transmitting the external synchronization signal and a pre-stored data signal on the basis of signals generated by an oscillating unit.

16. A system as claimed in claim 15, wherein the coil of the electronic timepiece is a motor coil.

17. A system as claimed in claim 15, wherein:

the external transmitting device further includes a receiver unit for receiving a transmission signal transmitted via the coil of the electronic timepiece; and the transmitter unit generates a regulating data signal based on the received transmission signal and transmits the generated regulating data signal to the electronic timepiece.

18. A control method for an electronic timepiece with a coil comprising:

a mode setting step for switching an operation mode of the electrical timepiece between a data receive mode and a normal operation mode in response to an external operation;

a synchronization signal generating step for generating, when the operation mode is in the data receive mode, an internal synchronization signal that is synchronized to an external synchronization signal transmitted from an external transmitting device;

a received data recovery step for recovering, when the operation mode is in the data receive mode, a received data on the basis of the internal synchronization signal and a data voltage signal induced across the coil by a data signal transmitted from the external transmitting device, and outputting the received data; and an operation control step for enabling recovery of the received data in the received data generating step only during a prescribed time period while the electronic timepiece is in the data receive mode.

19. A method for regulating, on the basis of data signals transmitted from an external transmitting device, an electronic timepiece including a coil; a signal input unit for inputting a signal in response to an external operation; and a mode setting unit for switching, in response to the signal, an operation mode of the electronic timepiece between a data receive mode and a normal operation mode, the method comprising:

a synchronization signal generating step for generating, when the operation mode is in the data receive mode, an internal synchronization signal that is synchronized to an external synchronization signal transmitted from the external transmitting device;

a received data recovery step for recovering, when the operation mode is in the data receive mode, a received data on the basis of the internal synchronization signal and a data voltage signal induced across the coil by a data signal transmitted from the external transmitting device, and outputting the received data; and an operation control step for, only during a prescribed time period during the data receive mode, enabling recovery of the received data in the received data generating step.

* * * * *